US005435140A

United States Patent [19]

Ishino et al.

[11] Patent Number: 5,435,140

[45] Date of Patent: Jul. 25, 1995

[54] VUILLEUMIER HEAT PUMP DEVICE

[75] Inventors: Tsutomu Ishino; Fumikazu Taniguchi, both of Osaka; Yoshikatsu Hiratsuka, Ibaragi; Masahiro Kitamoto, Osaka, all of Japan

[73] Assignee: Daikin Industries, Ltd., Osaka, Japan

[21] Appl. No.: 245,044

[22] Filed: May 17, 1994

[30] Foreign Application Priority Data

Sep. 17, 1992 [JP] Japan ..... 4-248154

[51] Int. Cl.[6] ..... F25B 9/00

[52] U.S. Cl. ..... 62/6; 60/524; 62/228.4

[58] Field of Search ..... 62/6, 228.4; 60/524

[56] References Cited

U.S. PATENT DOCUMENTS 4,969,333 11/1990 Osawa et al. ..... 62/6
5,142,872 9/1992 Tipton ..... 62/6
5,284,022 2/1994 Chung ..... 62/6

FOREIGN PATENT DOCUMENTS 3237841 12/1984 Germany .
4240359 8/1992 Japan .

OTHER PUBLICATIONS

"Proceedings of the 26th Intersociety Energy Conversion Engineering Conference", American Nuclear Society, Park, Ill., U.S., vol. 2, pp. 516–521.

"Revue Pratique du Froid et du Conditionnement D'Air", vol. 44, 64 Apr., 1989, Paris, FR, pp. 55–62.

*Primary Examiner*—William E. Wayner

*Attorney, Agent, or Firm*—Sixbey, Friedman, Leedom & Ferguson; Gerald J. Ferguson, Jr.

[57] ABSTRACT

Coefficient of performance ($COP_L$), ($COP_H$) is lowered when cooling capability or heating capability (Qk) is increased by increasing a revolution speed (N) because an working gas temperature (Tc) of a cold space (9L) drops and an working gas temperature (Tm) of a middle-temperature spaces (10H), (10L) rises. In order to avoid the lowering thereof, a vuilleumier heat pump device is provided with sensors (26), (29) for respectively detecting the respective working gas temperatures (Tc), (Tm), adjusting means (27), (30) for increasing or decreasing heat input of an endothermic heat exchanger (23) of a heat input circuit (22) and heat output of a radiation heat exchanger (25) of a radiation circuit (24) respectively, and control means (28), (31) for controlling the respective adjusting means (27), (30) so as to increase the heat input and the heat output in accordance with rise or drop of the gas temperature (Tc), (Tm).

7 Claims, 21 Drawing Sheets

VUILLEUMIER HEAT PUMP DEVICE

This is a continuation of International Application No. PCT/JP93/01246 filed on Sep. 2, 1993 which designated the United States and is now abandoned.

FIELD OF THE INVENTION

This invention relates to a vuilleumier heat pump device and particularly relates to a countermeasure for avoiding lowering of efficiency accompanied by capability control in the vuilleumier heat pump device.

BACKGROUND ART

A vuilleumier heat pump device is well known in the art such as disclosed in Laying Open unexamined Japanese Patent Application No.1-137164. In the vuilleumier heat pump device, as shown in FIG. 1, a displacer (3H) on hot side (hot side displacer) which is reciprocally movably inserted in a cylinder (1H) on hot side (hot side cylinder) and a displacer (3L) on cold side (cold side cylinder) which is reciprocally movably inserted in a cylinder (1L) on cold side (cold side cylinder) are connected to each other through the medium of a crank shaft (5). Each displacer (3H), (3L) is reciprocated at a set phase difference (e.g., 90°), and volumes of a hot space (9H) and middle-temperature space (10H) each defined and formed in the hot side cylinder (1H) by the hot side displacer (3H) and a cold space (9L) and a middle-temperature space (10L) each defined and formed in the cold side cylinder (1L) by the cold side displacer (3L) are respectively changed. Thereby, an working gas is changed in pressure to form a thermodynamic cycle. Also, heat input at a heater part (14H) which receives heat by a burner (17H) on the hot side cylinder side, heat input from a thermal medium, such as water, at a cooler part (17L) on the cold side cylinder side, and radiation to the thermal medium at middle-temperature heat exchangers (16H), (16L) are respectively conducted so that the thermal medium performs cooling or heating.

A vuilleumier heat pump device disclosed in Laying Open unexamined Japanese Patent Application No.4-240359 changes the cooling capability and heating capability by adjusting flow rate of the thermal medium circulated between the mid-die-temperature heat exchangers (16H), (16L) and the cooler part (17L), and each of indoor and outdoor heat exchangers (23), (25), or by adjusting heating amount or cooling amount.

In the vuilleumier heat pump device, the capability of the cooler part (17L) is controlled by increasing or decreasing a speed of rotation of the crank shaft (5) in such a manner that the crank shaft (5) is driven and rotated by a rotation control motor (21), or by adjusting a combustion rate of the burner (17H).

In this case, however, while the cooling capability and the heating capability are increased according to the increase in the revolution speed, the efficiency is lowered at that time. For example, in case of cooling, when the revolution speed (N) increases as shown in FIG.7, the cooling capability (Qk) is proportionally increased. At the same time, the temperature (Tc) of the working gas in the cold space (9L) lowers as indicated by a solid line in FIG.8 and the temperature (Tm) of the working gas in the middle-temperature spaces (10H), (10L) rises as indicated by a solid line in FIG.9. As a result, the coefficient of performance ($COP_L$) is gradually lowered as indicated by a solid line in FIG. 10.

This invention has been made in view of the above described disadvantages and has its object of avoiding the lowering of coefficient of performance due to such the capability control in a vuilleumier heat pump device.

SUMMARY OF THE INVENTION

To attain the above object, the present invention takes account of the latter prior art reference. At the capability increase, increased are the heat input of the cooler part according to temperature rise of the working gas in the cold space and the heat output of the middle-temperature heat exchanger according to temperature drop of the working gas in the middle-temperature space.

In detail, in the present invention, as shown in FIG. 1, a vuilleumier heat pump device is premised to have:

a hot side displacer (3H) defining a hot side cylinder (1H) into a hot space (9H) and a hot side middle-temperature space (10H) which are filled with an working gas;

a cold side displacer (3L) defining a cold side cylinder (1L) into a cold space (9L) and a cold side middle-temperature space (10L) which are filled with an working gas;

connection means (4) for connecting the hot side displacer (3H) and the cold side displacer (3L) so as to be in reciprocal motion at a set phase difference;

revolution speed adjusting means (21) driven and connected to each displacer (3H), (3L) through the connection means (4);

a hot communication passage (12H) interconnecting the hot space (9H) and the middle-temperature space (10H) in the hot side cylinder (1H), and provided with a heater part (14H) and a hot side middle-temperature heat exchanger (16H) radiating heat to a radiation medium by heat exchange with the working gas;

heating means (17H) for heating the heater part (14H);

a cold communication passage (12L) interconnecting the cold space (9L) and the middle-temperature space (10L) in the cold side cylinder (1L), and provided with a cooler part (17L) absorbing heat from an endothermic medium by heat exchange with the working gas and a cold side middle-temperature heat exchanger (16L) radiating heat to a radiation medium by heat exchange with the working gas;

an endothermic heat exchanger (23) connected to the cooler part (17L) via a heat input circuit (22) circulating and flowing the endothermic medium, and making the endothermic medium absorb heat from an external medium; and a radiation heat exchanger (25) connected to the middle-temperature heat exchangers (16H), (16L) via a radiation circuit (24) circulating and flowing the radiation medium, and making the external medium radiate heat from the radiation medium. The vuilleumier heat pump device comprises:

cold space temperature detection means (26) for detecting an working gas temperature (Tc) of the cold space (9L);

heat input adjusting means (27) for increasing or decreasing heat input of the endothermic heat exchanger (23);

heat input control means (28) for controlling the heat input adjusting means (27) so as to increase the heat input in accordance with drop of the working gas temperature (Tc) upon receipt of an output signal of the cold space temperature detection means (26);

middle-temperature space temperature detection means (29) for detecting an working gas temperature (Tm) of the middle-temperature spaces (10H), (10L);

heat output adjusting means (30) for increasing or decreasing the heat output of the radiation heat exchanger (25); and heat output control means (31) for controlling the heat output adjusting means (30) so as to increase the heat output in accordance with rise in the working gas temperature (Tm) upon receipt of an output signal of the middle-temperature space temperature detection means (29).

According to this construction, when the working gas temperature (Tc) of the cold space (9L) drops in accordance with the increase in revolution speed (N), the heat input control means (28) which receives an output signal of the cold space temperature detection means (26) which detects the working gas temperature (Tc) controls the heat input adjusting means (27), and heat input of the endothermic medium, circulating and flowing along the heat input circuit (22), from an external medium is increased in the endothermic heat exchanger (23) of the heat input circuit (22), so that the endothermic medium is increased in temperature by the increase of the heat input. This temperature rise of the endothermic medium increases the heat input of the working gas from the endothermic medium at the cooler part (17L) and makes the working gas flow into the cold space (9L) in the cold side cylinder (1L) through the cold communication passage (12L) after temperature rise. Thereby, the working gas temperature (Tc) in the cold space (9L) is prevented from lowering.

Meanwhile, when the working gas temperature (Tm) of the middle-temperature spaces (10H), (10L) rises in accordance with the increase in revolution speed (N), the heat output control means (31) which receives an output signal of the middle-temperature space temperature detection means (29) which detects the working gas temperature (Tm) controls the heat output adjusting means (30) and the heat output of the radiation medium, circulating and flowing along the radiation circuit (24), to the external medium is increased in the radiation heat exchanger (25) of the radiation circuit (24), so that the temperature of the radiation medium drops by the increase of the heat output. This temperature drop of the radiation medium increases the heat output of the working gas to the radiation medium at the middle-temperature heat exchangers (16H), (16L), and makes the working gas flow into the respective middle-temperature spaces (10H), (10L) of the hot side cylinder (1H) and the cold side cylinder (1L) through the hot communication passage (12H) and the cold communication passage (12L) after temperature drop. Thereby, the working gas temperature (Tm) of the middle-temperature spaces (10H), (10L) are prevented from rising.

In this way, the heat input of the cooler part is increased by increasing heat input of the endothermic heat exchanger of the heat input circuit connected to the cooler part, while the heat output of the middle-temperature heat exchanger is increased by increasing the heat output of the radiation heat exchanger of the radiation circuit connected to the middle-temperature heat exchanger. Thereby, each temperature of the working gas in cold and middle-temperature spaces is kept constant at the capability increase. Thus the capability is increased without lowering of the coefficient of performance.

In the above vuilleumier heat pump device, either combinations may be provided of the cold space temperature detection means (26), the heat input adjusting means (27) and the heat input control means (28) or of the middle-temperature space temperature detection means (29), the heat output adjusting means (30) and the heat output control means (31).

In detail, in the former case with the cold space temperature detection means (26), the heat input adjusting means (27) and the heat input control means (28), when the working gas temperature (Tc) of the cold space (9L) drops in accordance with the increase in the revolution speed (N), as well as in the above case, the heat input adjusting means (27) is controlled by the heat input control means (28) which receives an output signal of the cold space temperature detection means (26), and the temperature of the endothermic medium rises by increase In the heat input of the endothermic medium from the external medium in the endothermic heat exchanger (23) of the heat input circuit (22). Also, the heat input of the working gas from the endothermic medium increases at the cooler part (17L), and the working gas flows into the cold space (9L) in the cold side cylinder (1L) through the cold communication passage (12L) after temperature rise. Thereby, the working gas temperature (Tc) of the cold space (9L) is prevented from lowering and is kept constant at capability increase, thus increasing the capability without lowering of the coefficient of performance.

In the latter case with the middle-temperature space temperature detection means (29), the heat output adjusting means (30) and the heat output control means (31), when the working gas temperature (Tm) of the middle-temperature spaces (10H), (10L) rises in accordance with the increase in the revolution speed (N), as well as in the above case, the heat output adjusting means (30) is controlled by the heat output control means (31) which receives an output signal of the middle-temperature space temperature detection means (29), and the heat output of the radiation medium to the external medium increases in the radiation heat exchanger (25) of the radiation circuit (24), so that the temperature of the radiation medium drops by the increase of the heat output. Also, the heat output of the working gas to the radiation medium increases at the middle-temperature heat exchangers (16H), (16L), and the working gas flows into the respective middle-temperature spaces (10H), (10L) of the hot side cylinder (1H) and the cold side cylinder (1L) through the hot communication passage (12H) and the cold communication passage (12L) after temperature drop. Thereby, the working gas temperature (Tm) of the middle-temperature spaces (10H), (10L) is prevented from rising. As a result, each working gas temperature of cold and middle-temperature spaces (10H), (10L) are kept almost constant at capability increase, and the capability can be increased without lowering of the coefficient of performance.

Further, in the above construction, the heat input adjusting means (27) may be a pump (27*a*) for circulating and flowing the endothermic medium along the heat input circuit (22). Accordingly, the heat input of the endothermic heat exchanger (23) is increased by increasing the flow rate of the endothermic medium by the pump (27*a*).

According to this construction, the flow rate of the endothermic medium circulating and flowing in the heat input circuit (22) is increased by the pump (27*a*) of the heat input adjusting means (27) when the working gas temperature (Tc) of the cold space (9L) drops, so that the heat input of the endothermic medium from the external medium is increased at the endothermic heat exchanger (23). Thereby, the increase in the heat input at the endothermic heat exchanger is facilitated by controlling the flow rate of the endothermic medium in the heat input circuit.

Otherwise, the heat input adjusting means (27) may be a fan (27*b*) for flowing the external medium in the endothermic heat exchanger (23). Accordingly, the heat input at the endothermic heat exchanger is increased by increasing the flow rate of the external medium by the fan (27*b*).

According to the above construction, the flow rate of the external medium in the endothermic heat exchanger (23) is increased by the fan (27*b*) of the heat input adjusting means (27) when the working gas temperature (Tc) of the cold space (9L) drops, so that the heat input of the endothermic medium from the external medium is increased at the endothermic heat exchanger (23). Thereby the increase in heat input at the endothermic heat exchanger is facilitated by controlling the flow rate of the external medium in the endothermic heat exchanger.

Further, the heat output adjusting means (30) may be a pump (30*a*) for circulating and flowing the radiation medium along the radiation circuit (24). Accordingly, the heat output of the radiation heat exchanger (25) is increased by increasing the flow rate of the radiation medium by the pump (30*a*).

According to the above construction, the flow rate of the radiation medium circulating and flowing in the radiation circuit (24) is increased by the pump (30*a*) of the heat output adjusting means (30) when the working gas temperature (Tm) of the middle-temperature spaces (10H), (10L) rises, so that the heat output of the radiation medium to the external medium is increased in the radiation heat exchanger (25). Accordingly, the increase in the heat output at the radiation heat exchanger is facilitated by controlling the flow rate of the radiation medium of the radiation circuit.

Otherwise, the heat output adjusting means (30) may be a fan (30*b*) for flowing the external medium at the radiation heat exchanger (25). The heat output of the radiation heat exchanger (25) is increased by increasing the flow rate of the external medium by the fan (30*b*).

According to the above construction, the flow rate of the external medium at the radiation heat exchanger (25) is increased by the fan (30*b*) of the heat output adjusting means (30) when the working gas temperature (Tm) in the middle-temperature spaces (10H), (10L) rises, so that the heat output of the radiation medium to the external medium is increased at the radiation heat exchanger (25). Namely, the increase in the heat output at the radiation heat exchanger is facilitated by controlling the flow rate of the external medium in the radiation heat exchanger.

BRIEF DESCRIPTION OF THE ACCOMPANYING DRAWINGS

BEST MODE FOR CARRYING OUT THE INVENTION

Description of the best mode for carrying out the present invention is made below as embodiments, with reference to FIG. 2 and subsequent drawings.

Figure 1:
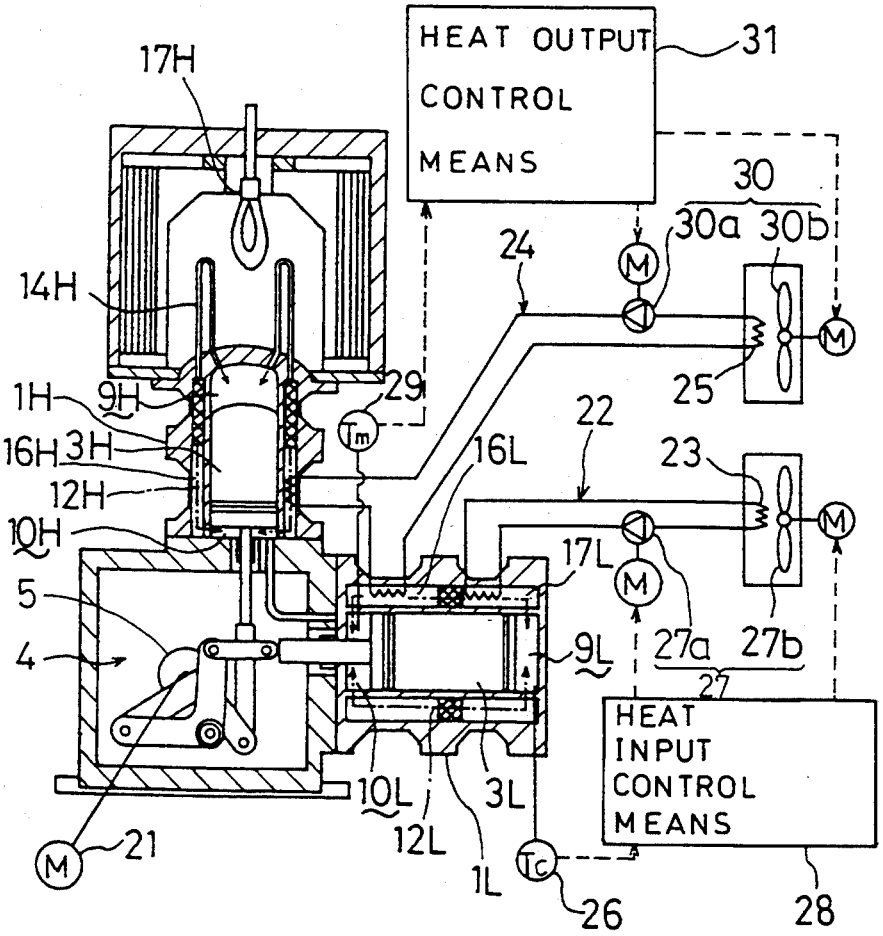
FIG. 1 illustrates a construction of the present invention.
Figure 2:
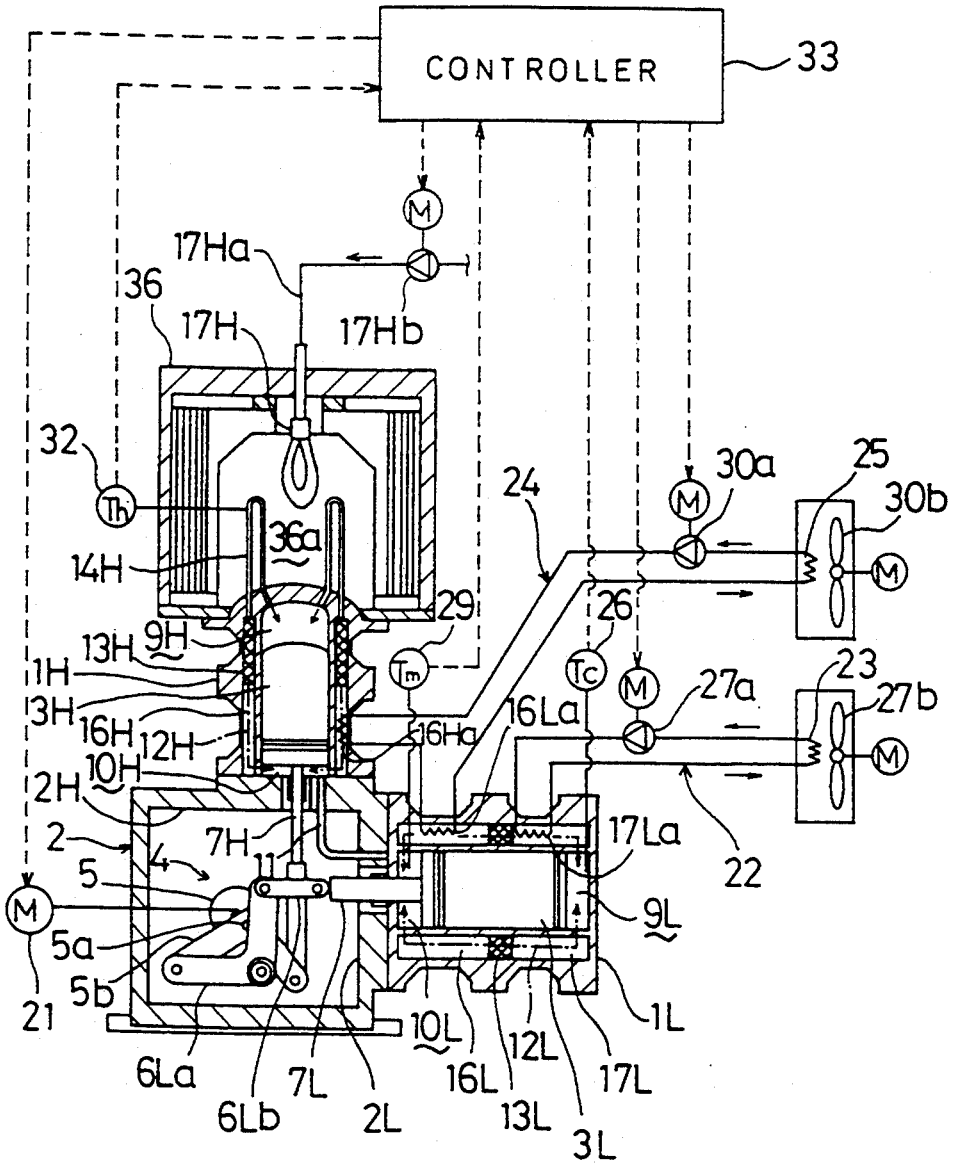
FIG. 2 illustrates a whole construction of a vuilleumier heat pump device according to a first embodiment of the present invention.

FIG. 2 shows a vuilleumier heat pump device according to a first embodiment of the present invention. In the pump device, hot side and cold side cylinders (1H), (1L) crossing at, for example, 90° with each other are integrally jointed to bulkheads (2H), (2L) of a crank case (2) respectively, and are shut in a sealed condition. A hot side displacer (3H) and a cold side displacer (3L) are respectively inserted in the hot side cylinder (1H) and the cold side cylinder (1L) so as to be reciprocally movable.

Both displacers (3H), (3L) are connected to each other by a connection mechanism (4) as connection means so as to move reciprocally with a phase difference of, for example, 90°. The connection mechanism (4) has a crank shaft (5) supported by the crank case (2) with a rotational center in a horizontal direction. A crank pin (5*a*) located within the crank case (2) is provided to the crank shaft (5). The crank shaft (5) is connected at one end thereof to a rotation control motor (21) as revolution speed adjusting means. A base end of a hot rod (7H) is connected via a link (5*b*) to the crank pin (5*a*). The hot rod (TH) slidably passes through the bulkhead (2H) in sealed condition and is connected at an extreme end thereof to a base end of the hot side displacer (3H). A base end of a cold rod (7L) is connected via links (5*b*), (6La), (6Lb) to the crank pin (5*a*). The cold rod (7L) slidably passes through the bulkhead (2L) in sealed condition, and is connected at another end thereof to a base end of the cold side displacer (3H). In other words, both displacers (3H), (3L) are in reciprocal motion at a set phase difference (90°) under the intersection layout of the cylinders (1H), (1L).

The hot side displacer (3H) defines the hot side cylinder (1H) into a hot space (9H) on another end side and a hot side middle-temperature space (10H) on a base end side. The middle-temperature space (10H) is communicated with the hot space (9H) by a hot communication passage (12H) a part of which is a space inside of a cylindrical peripheral wall formed around the hot side cylinder (1H). On the other hand, the cold side displacer (3L) defines the cold side cylinder (1L) into a cold space (9L) on an extreme end side and a cold side middle-temperature space (10L) on a base end side. The middle-temperature space (10L) is communicated with the cold space (9L) by a cold communication passage (12L) a part of which is a space inside of a cylindrical peripheral wall formed around the cold side cylinder (1L). The middle-temperature space (10H) on the hot side cylinder (1H) side and the middle-temperature space (10L) on the cold side cylinder (1L) side are connected by a middle-temperature connection tube (11), and hot, middle-temperature and cold spaces (9H), (10H), (10L), (9L) are filled with an working gas such as helium.

The hot communication passage (12H) is provided with a hot regenerator (13H) composed of a heat accumulation type heat exchanger, a heater tube (14H) as a heating heat exchanger located on the hot space (9H) side of the regenerator (13H), and a shell-and-tube type hot side middle-temperature heat exchanger (16H) located on the middle-temperature space (10H) side of the regenerator (13H). A combustion case (39) having a sealed combustion space (39*a*) is integrally mounted at the upper part of the hot side cylinder (1H). In the combustion space (39*a*) in the combustion case (39), a burner (17H) as heating means for heating the working gas in the heater tube (14H) by burning fuel from a fuel supply tube (17Ha) is arranged at a portion opposed to the heater tube (14H). The fuel supply tube (17Ha) is provided with a motor pump (17Hb) for controlling fuel supply amount in order to adjust the heat rate of the burner (17H).

On the other hand, the cold communication passage (12L) is provided with a cold regenerator (13L) composed of a heat accumulation type heat exchanger, a shell-and-tube type cooler (17L) as a cooling heat exchanger located on the cold space (9L) side of the regenerator (13L), and a cold side middle-temperature heat exchanger (16L) of shell-and-tube type which is located on the middle-temperature space (10L) side of the regenerator (13L). A heat transfer tube (16La) of the heat exchanger (16L) is connected in series to a heat transfer tube (16Ha) of the hot side middle-temperature heat exchanger (16H).

Figure 3:
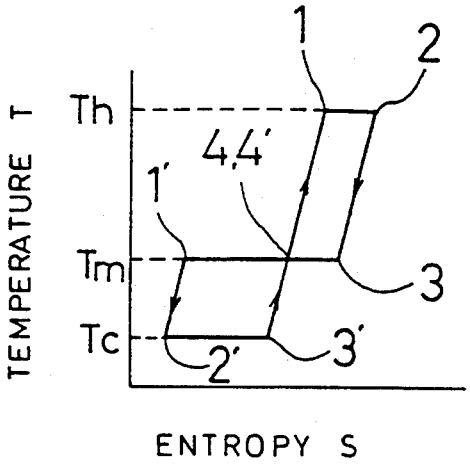
FIG. 3 is a graph showing T-s dependencies of a vuilleumier heat pump cycle.

In the vuilleumier heat pump cycle with the above construction, the relation between the working gas temperature (T) and the entropy (s) is indicated by T-s curves in FIG. 3. In detail, in cycle on the hot side, the working gas is isothermally expanded by heat input from the heater tube (14H) heated by the burner (17H) at a process from 1 to 2, then is equivalently cooled by providing the heat to the hot regenerator (13H) at a process from 2 to 3. Next, the working gas is isothermally compressed by radiation through the hot side middle-temperature heat exchanger (16H) at a process from 3 to 4, then is equivalently heated by the heat provided to the regenerator (13H) at a process from 4 to 1. On the other hand, in cycle on the cold side, the working gas is equivalently cooled by providing the heat to the cold regenerator (13L) at a process from 1′ to 2′, isothermally expanded by heat input from the cooler (17L) at a process from 2′ to 3′, equivalently heated by the heat provided to the regenerator (13L) at a process from 3′ to 4′, then isothermally compressed by radiation through the cold side middle-temperature heat exchanger (16L) at a process from 4′ to 1′.

A heat input circuit (22) for circulating and flowing water as an endothermic medium for heat-exchanging with the working gas in the cooler (17L) is connected to the heat transfer tube (17La) of the cooler (17L) in the cold side cylinder (1L). As well, a radiation circuit (24) for circulating and flowing water as a radiation medium for heat-exchanging with the working gas in the middle-temperature heat exchangers (16H), (16L) is connected to the heat transfer tubes (16Ha), (16La) of the middle-temperature heat exchangers (16H), (16L) in the cylinders (1H), (1L) respectively.

The heat input circuit (22) is connected to an indoor heat exchanger (23) as an endothermic heat exchanger for making water in the heat input circuit (22) absorb the heat from indoor air as an external medium. Arranged at the middle of the heat input circuit (22) is a pump (27*a*) for circulating and flowing water between the indoor heat exchanger (23) and the cooler (17L).

On the other hand, the radiation circuit (24) is connected to an outdoor heat exchanger (25) as a radiation heat exchanger for radiating the heat of the water in the radiation circuit (24) to outdoor air as an external medium. The radiation circuit (24) is provided with a pump (30*a*) for circulating and flowing water between the outdoor heat exchanger (25) and the middle-temperature heat exchangers (16H), (16L). Reference (27*b*) indicates an indoor fan for blowing the indoor air to the indoor heat exchanger (23), and (30*b*) indicates an outdoor fan for blowing the outdoor air to the outdoor heat exchanger (25).

Further provided are a heater wall temperature sensor (32) for detecting wall temperature (Th) of the heater tube (14H), a cold space temperature sensor (26) as cold space temperature detection means for detecting the working gas temperature (Tc) of the cold space (9L) in the cold side cylinder (1L), and a middle-temperature space temperature sensor (29) as middle-temperature space temperature detection means for detecting the working gas temperature (Tm) of the middle-temperature space (10L) in the cold side cylinder (1L). These sensors (32), (26), (29) are connected to a controller (33) for outputting a control signal to each of a motor for the pump (17Hb) of the burner (17H), a motor for the pump (27*a*) of the heat input circuit (22) and a motor for the pump (30*a*) of the radiation circuit (24).

Figure 4:
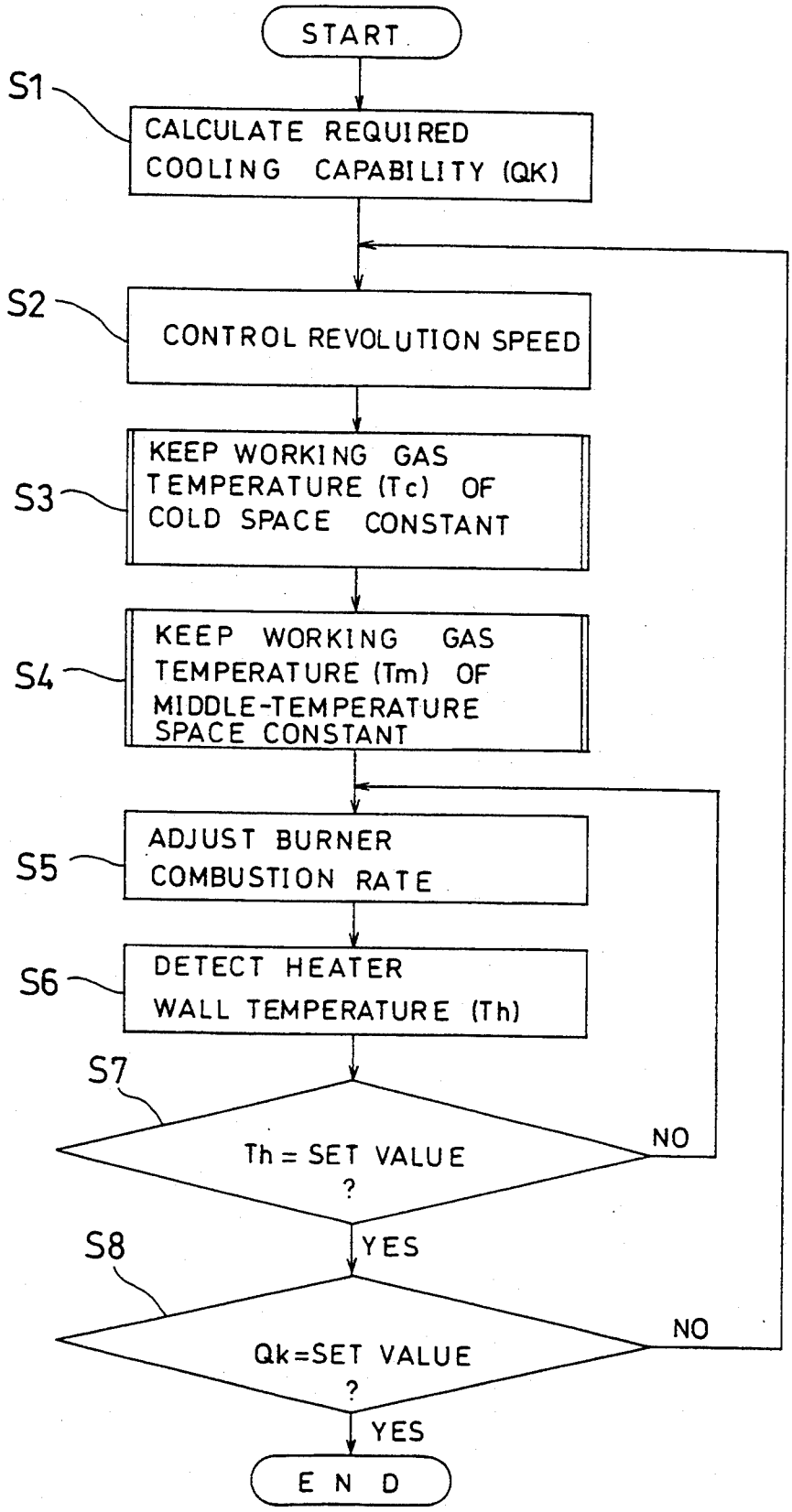
FIG. 4 is a flow chart showing a processing operation at capability control in the first embodiment.

The processing operation for controlling the capability by the controller (33) is discussed, with reference to a flow chart of FIG. 4. At a step S1 after process start, a required cooling capability (Qk) is calculated based on a load of the device. After the revolution speed (N) is controlled at a step S2, the routine proceeds to steps S3 and S4.

Figure 5:
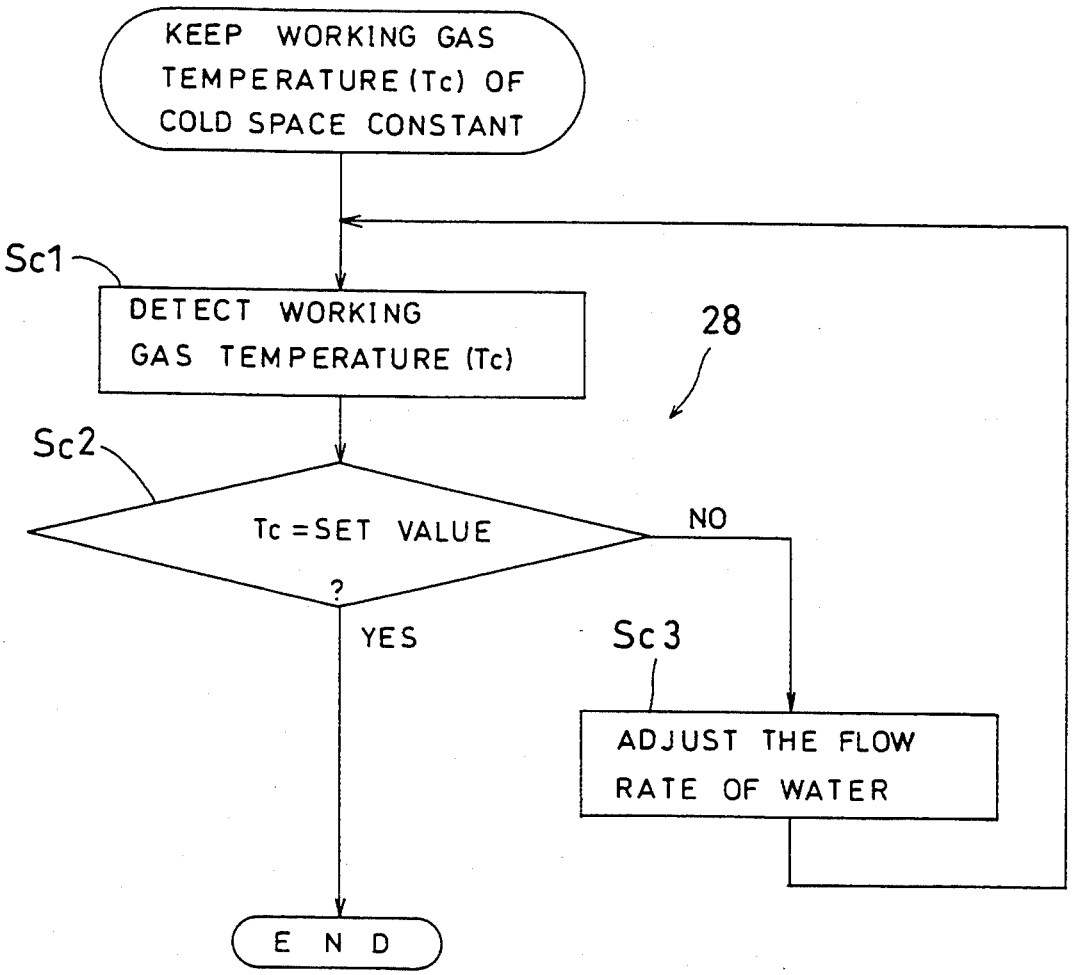
FIG. 5 is a flow chart showing a processing operation for keeping temperature of a cold space constant at the capability control in the first embodiment.

The steps S3, S4 are designed as a subroutine for keeping respective working gas temperatures (Tc), (Tm) of the cold space (9L) and the middle-temperature space (10L) constant, which is the feature of the present invention. At the step S3 shown in detail in FIG. 5, the working gas temperature (Tc) of the cold space (9L) is kept constant. In detail, after the working gas temperature (Tc) is detected at a step Sc1, the subroutine proceeds to a step Sc2 to judge whether the working gas temperature (Tc) is equal to a set value. When the judgment result in YES, the subroutine terminates to proceed to the step S4. When the judgment results in NO, the subroutine proceeds to a step Sc3 to adjust the flow rate of circulation water (Qw) of the heat input circuit (22). In detail, the flow rate of circulation water (Qw) is increased when the working gas temperature (Tc) is less than the set value, or the flow rate of circulation water (Qw) is decreased when the working gas temperature (Tc) is more than the set value. Thereafter, the subroutine returns to the step Sc1 to detect the working gas temperature (Tc) again. The above processing of the steps Sc2 and Sc3 is embodied in heat input control means (28) for controlling the motor for the pump (27*a*) of the heat input circuit (22) so as to increase the heat input according to drop of the working gas temperature (Tc) of the cold space (PL) upon receipt of an output signal of the cold space temperature sensor (26).

Figure 6:
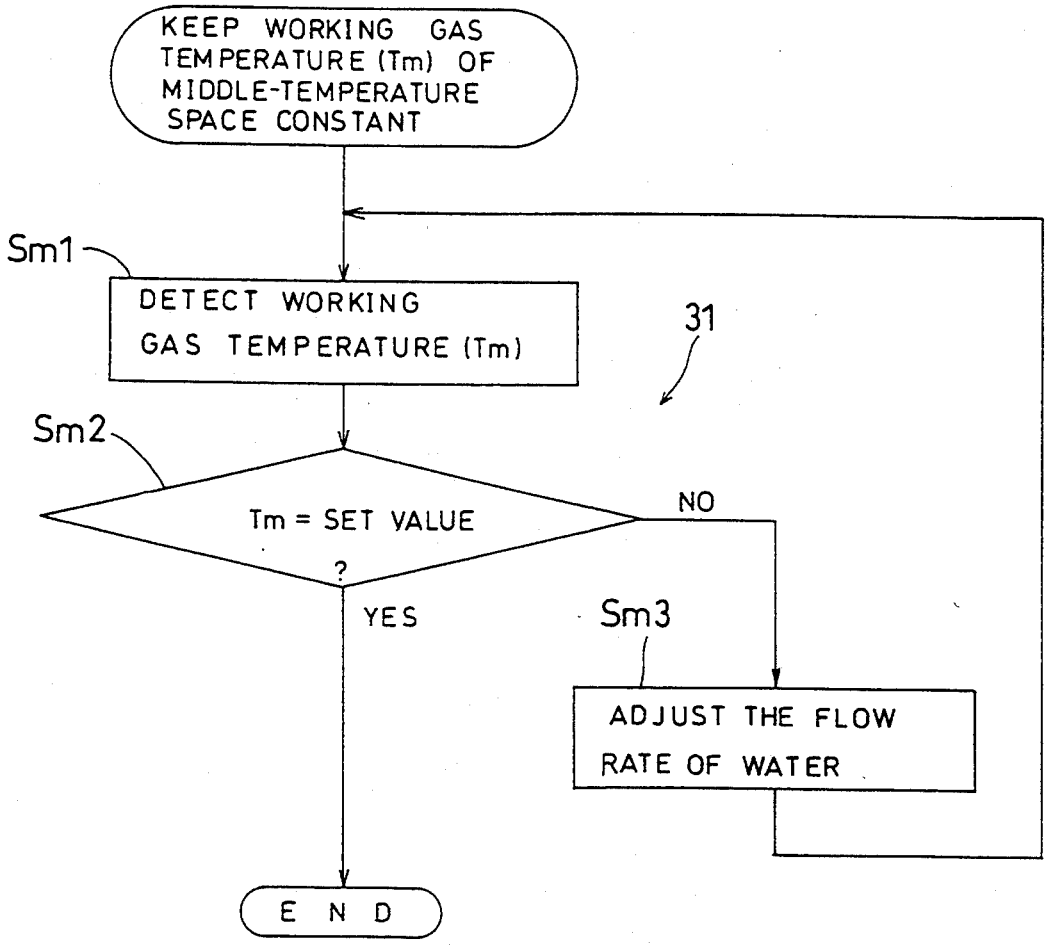
FIG. 6 is a flow chart showing a processing operation for keeping temperature of a middle-temperature space constant at the capability control in the first embodiment.

On the other hand, the step S4 is designed as a subroutine for keeping the working gas temperature (Tm) of the middle-temperature space (10L) constant. In the subroutine, as shown in FIG. 6, after the working gas temperature (Tm) is detected at a step Sm1 after process start, the subroutine proceeds to a step Sm2 to judge whether the working gas temperature (Tm) is equal to a set value. When the judgment results in YES, the subroutine terminates to proceed to a step S5. When the judgment results in NO, the subroutine proceeds to a step Sm3 to adjust the flow rate of the circulation water (Qw) of the radiation circuit (24). In detail, the flow rate of circulation water (Qw) is increased when the working gas temperature (Tm) is more than the set value, or the flow rate of circulation water (Qw) is decreased when the working gas temperature (Tm) is less than the set value. Thereafter, the subroutine returns to the step Sm1 to detect the working gas temperature (Tm) again. The processing of the steps Sm2 and Sm3 is embodied in heat output control means (31) for controlling the motor for the pump (30*a*) of the radiation circuit (24) so as to increase the heat output according to rise of the working gas temperature (Tm) in the middle-temperature space (10L) upon receipt of an output signal of the middle-temperature space temperature sensor (29).

After the process of the steps S3, S4, the routine proceeds to the step S5 shown in FIG. 4. The combustion rate of the burner (17ti) is adjusted at the step S5, the heater wall temperature (Th) is detected at a step S6, then the routine proceeds to a step S7. At the step S7, whether the heater wall temperature (Th) is equal to a set value is judged. When the judgment result in NO, the routine returns to the step S5 to adjust the combustion rate of the burner (17H) again. When the judgment results in YES, the routine proceeds to a step S8 to judge whether the cooling capability (Qk) is equal to a set value. When the judgment results in YES, the routine terminates. When the judgment results in NO, the routine returns to the step S2.

Figure 7:
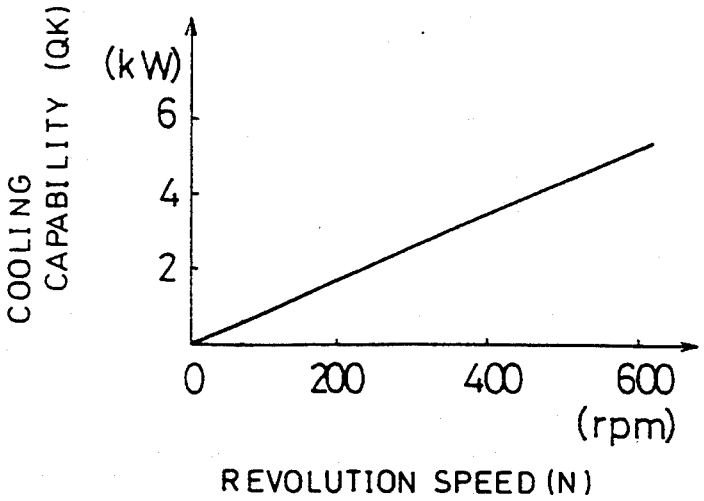
FIG. 7 is a graph showing a relation between cooling capability and revolution speed in the first embodiment.
Figure 9:
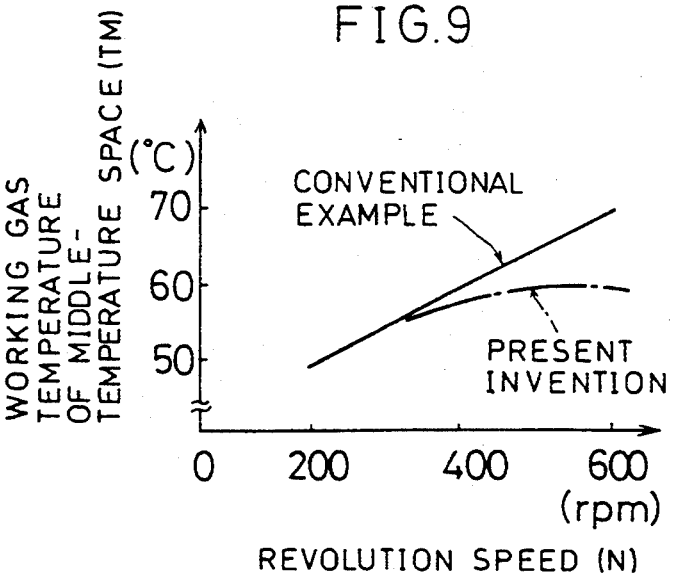
FIG. 9 is a graph showing a relation between temperature of the middle-temperature space and revolution speed in the first embodiment.
Figure 8:
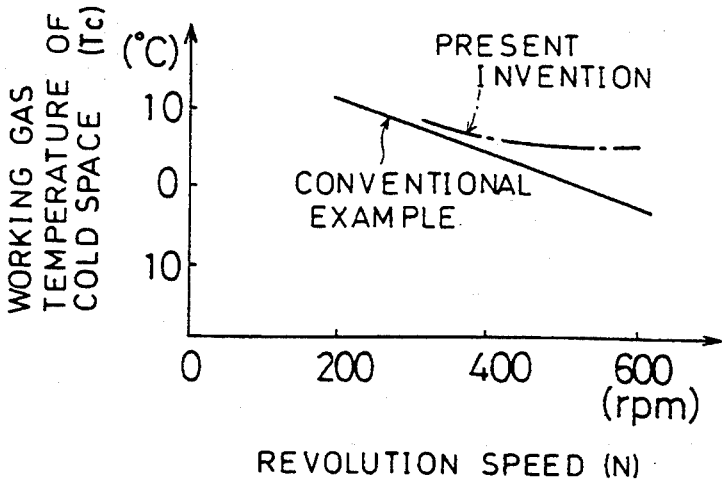
FIG. 8 is a graph showing a relation between temperature of the cold space and revolution speed in the first embodiment.

Described next is the operation of the vullleumier heat pump device with the above construction. In order to increase the cooling capability (Qk) of the cooler (17L), the revolution speed (N) is controlled and the combustion rate of the burner (17H) is adjusted. Thereby, the cooling capability (Qk) is increased, as shown in FIG. 7, in accordance with the increase in the revolution speed (N). Wherein, as indicated by solid lines in FIGS. 8 and 9, in a conventional example, the working gas temperature (Tc) of the cold space (9L) drops and the working gas temperature (Tm) of the middle-temperature space (10L) rises, with a result that the coefficient of performance ($COP_L$) is lowered as indicated by a solid line in FIG. 10.

Figure 11:
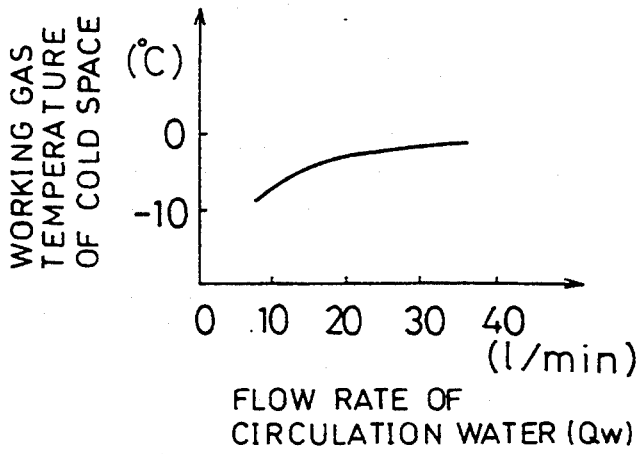
FIG. 11 is a graph showing a relation between flow rate of circulation water in a heat input circuit and temperature of the cold space in the first embodiment.

However, according to the present invention, the working gas temperature (Tc) of the cold space (9L) is detected by the cold space temperature sensor (26) first, then the motor for the pump (27*a*) of the heat input circuit (22) is controlled by the controller (33) upon receipt of an output signal of the sensor (26) to increase the flow rate of circulation water (Qw) of the heat input circuit (22). Thereby, the heat input of the water in the heat input circuit (22) from the indoor air is increased at the indoor heat exchanger (23) and the temperature of the water in the heat input circuit (22) is increased by the increase of the heat input. The temperature rise of the water increases the heat input of the working gas from the water at the cooler (17L) to raise the working gas temperature, and makes the working gas flow into the cold space (9L) in the cold side cylinder (1L) through the cold communication passage (12L). Accordingly, the increase in the flow rate of circulation water (Qw) prevents the drop of the working gas temperature (Tc) as shown in FIG. 11, and the working gas temperature (Tc) is kept constant as indicated by a dot-dash line in FIG. 8, regardless of the increase in the revolution speed (N).

Figure 12:
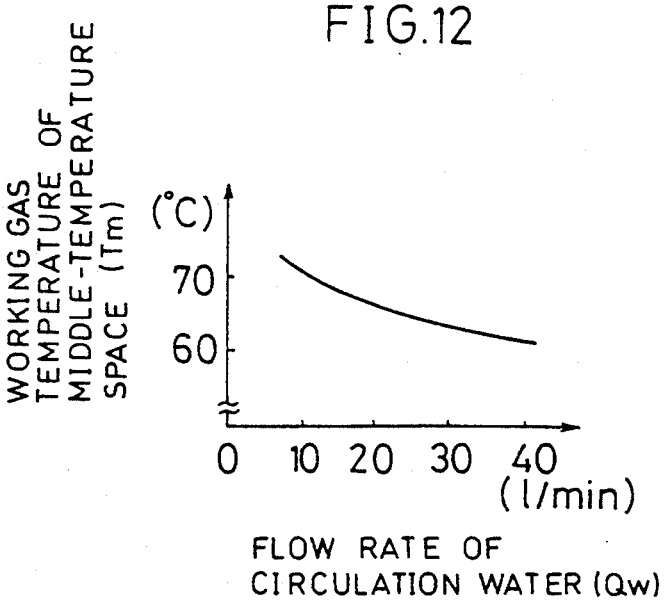
FIG. 12 is a graph showing a relation between flow rate of circulation water in the heat input circuit and temperature of the middle-temperature space in the first embodiment.

On the other hand, the working gas temperature (Tm) of the middle-temperature space (10L) is detected by the middle-temperature space temperature sensor (29), and the motor for the pump (30*a*) of the radiation circuit (24) is controlled by the controller (33) upon receipt of an output signal of the sensor (29) to increase the flow rate of circulation water (Qw) in the radiation circuit (24). Thereby, the heat output of the water in the radiation circuit (24) to the outdoor air is increased at the outdoor heat exchanger (25) and the temperature of the water in the radiation circuit (24) drops by the increase of the heat output. This temperature drop of the water increases the heat output of the working gas to the water at the middle-temperature heat exchangers (16H), (16L) to drop the working gas temperature, and makes the working gas flow into the middle-temperature spaces (10H), (10L) of the hot side cylinder (1H) and the cold side cylinder (1L) through the hot communication passage (12H) and the cold communication passage (12L) respectively. Accordingly, as shown in FIG. 12, the increase in the flow rate of circulation water (Qw) prevents the rise of the working gas temperature (Tm), and the working gas temperature (Tm) is kept almost constant as indicated by a dot-dash line in FIG. 9, regardless of the increase in the revolution speed (N).

The relation between the flow rate of circulation water (Qw) and the working gas temperatures (Tc), (Tm) is referred to in detail. Suppose that the working gas temperature (Tc) of the cold space (9L) is −3.3° C. and the working gas temperature (Tm) of the middle-temperature space (10L) is 68.5° C. when each flow rate of circulation water (Qw) is 12.61/min. under the control of, for example, 650° C. working gas temperature (Th) of the hot space (9H) and 600rpm revolution speed (N), the coefficient of performance ($COP_L$) is:

$$COP_L = (Tc/Th)\cdot\{(Th - Tm)/(Tm - Tc)\} = 2.36$$

(wherein unit is an absolute temperature)

When each flow rate of circulation water (Qw) is increased to 37.81/min., the working gas temperature (Tc) of the cold space (9L) rises to −0.5° C. and the working gas temperature (Tm) of the middle-temperature space (10L) drops to 63.0° C. In this case, the coefficient of performance ($COP_L$) is increased to 2.77.

Figure 10:
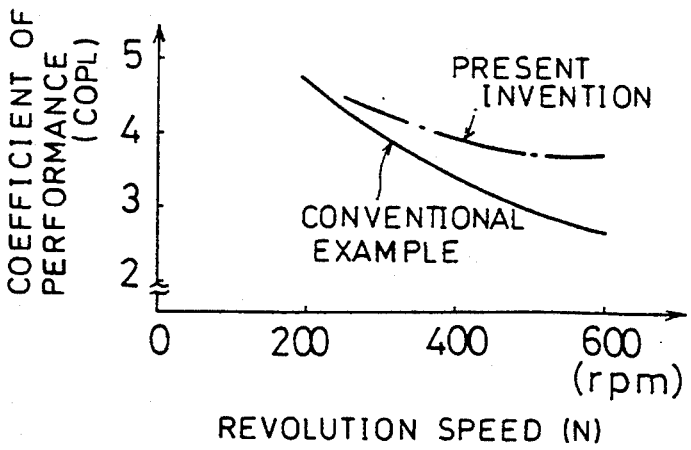
FIG. 10 is a graph showing a relation between coefficient of performance and revolution speed in the first embodiment.

In this way, since the working gas temperatures (Tc), (Tm) are kept constant, the lowering of the coefficient of performance ($COP_L$) is gradually lessened as indicated by a dot-dash line in FIG. 10 to be almost constant.

Figure 13:
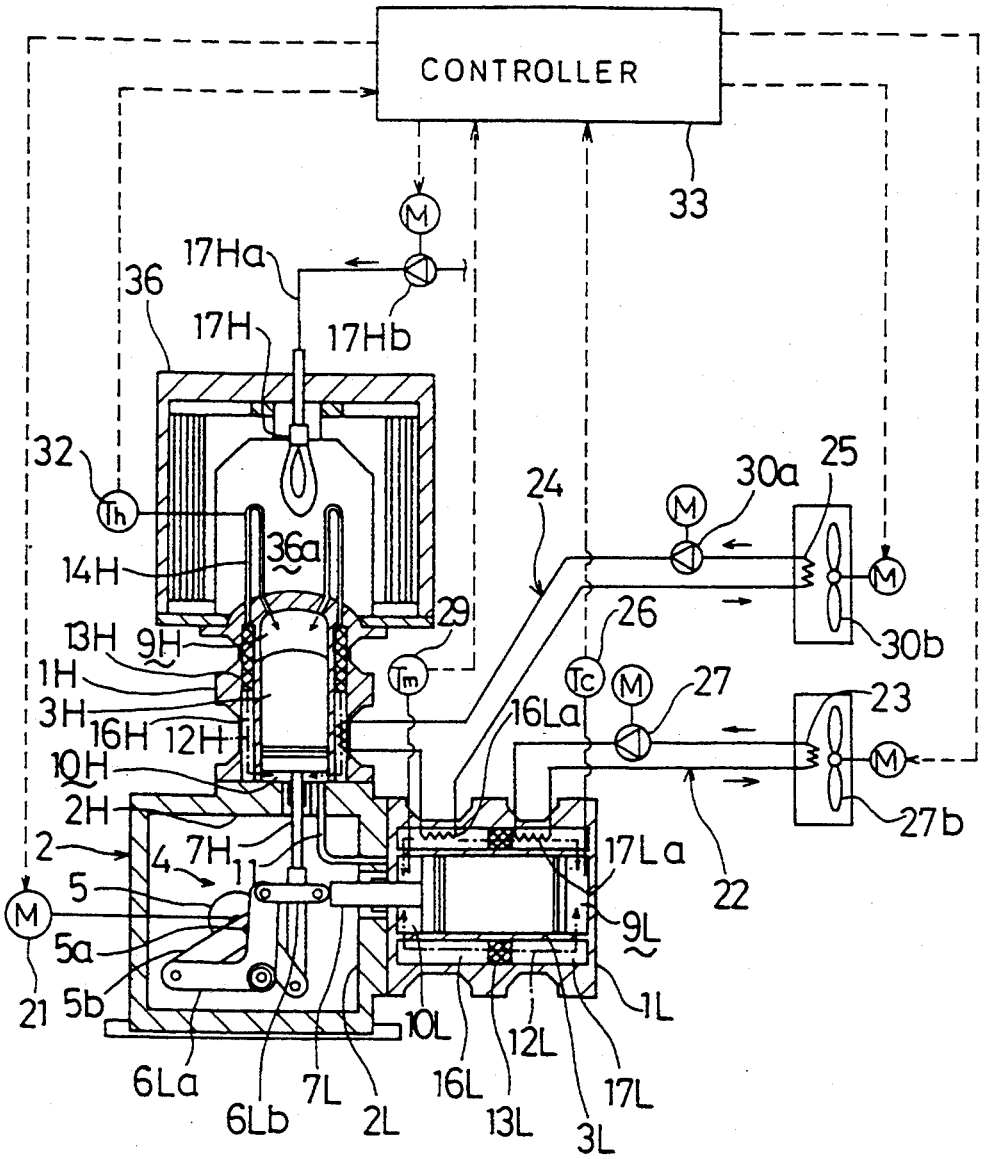
FIG. 13 illustrates a whole construction of a vuilleumier heat pump device according to a second embodiment of the present invention.

FIG. 13 shows a second embodiment of the present invention, wherein the same reference numerals have been used to the same elements as in FIG. 2, omitting the explanation thereof. In the vuilleumier heat pump device according to this embodiment an indoor fan (27*b*) for blowing air to the indoor' heat exchanger (23) of the heat input circuit (22) serves as the heat input adjusting means for flowing the indoor air as the external medium at the indoor heat exchanger (23), and an outdoor fan (30*b*) for blowing air to the outdoor heat exchanger (25) of the radiation circuit (24) serves as the heat output adjusting means for flowing the outdoor air as the external medium at the outdoor heat exchanger (25). The controller (33) to which respective output signals of the cold space temperature sensor (26) and the middle-temperature space temperature sensor (29) are inputted is connected so as to output a control signal to each motor of the indoor fan (27*b*) and the outdoor fan (30*b*).

Figure 14:
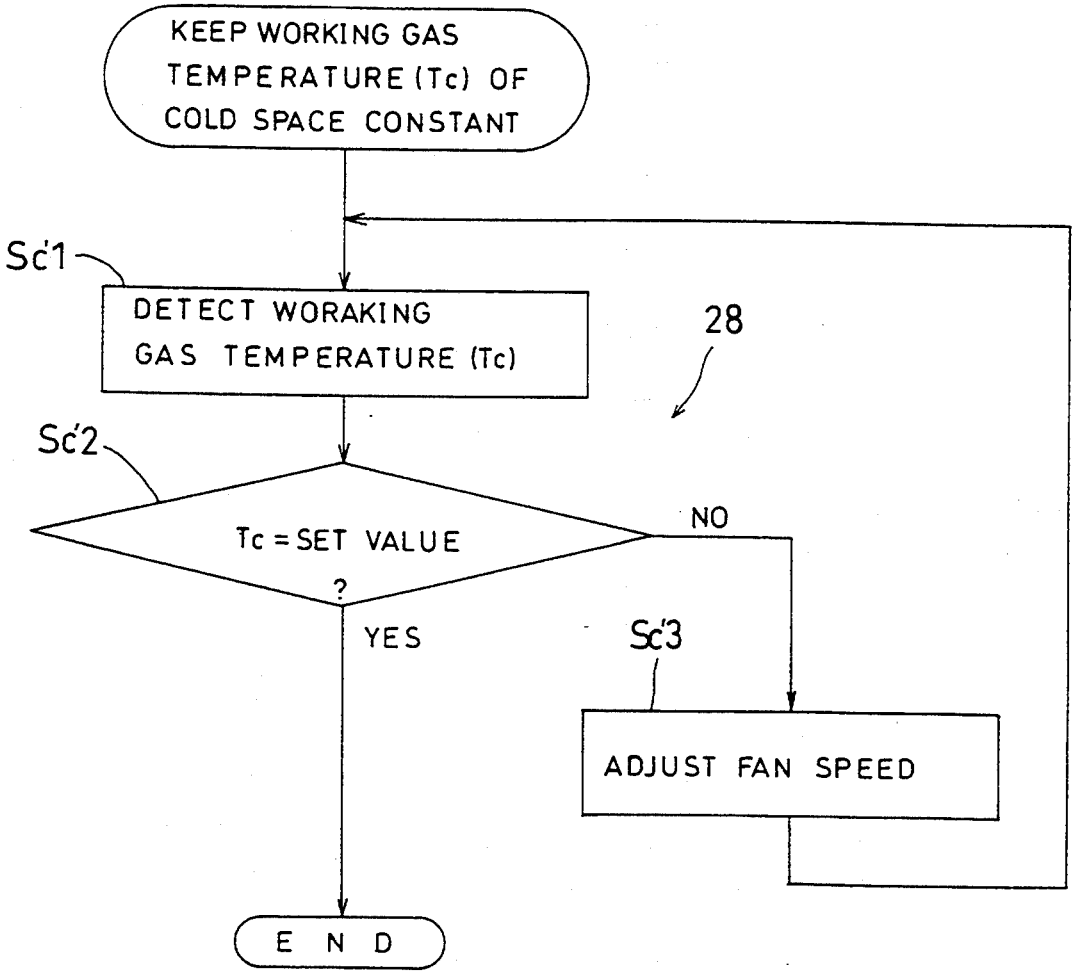
FIG. 14 is a flow chart showing a processing operation for keeping working gas temperature of the cold space constant at the capability control in the second embodiment.
Figure 15:
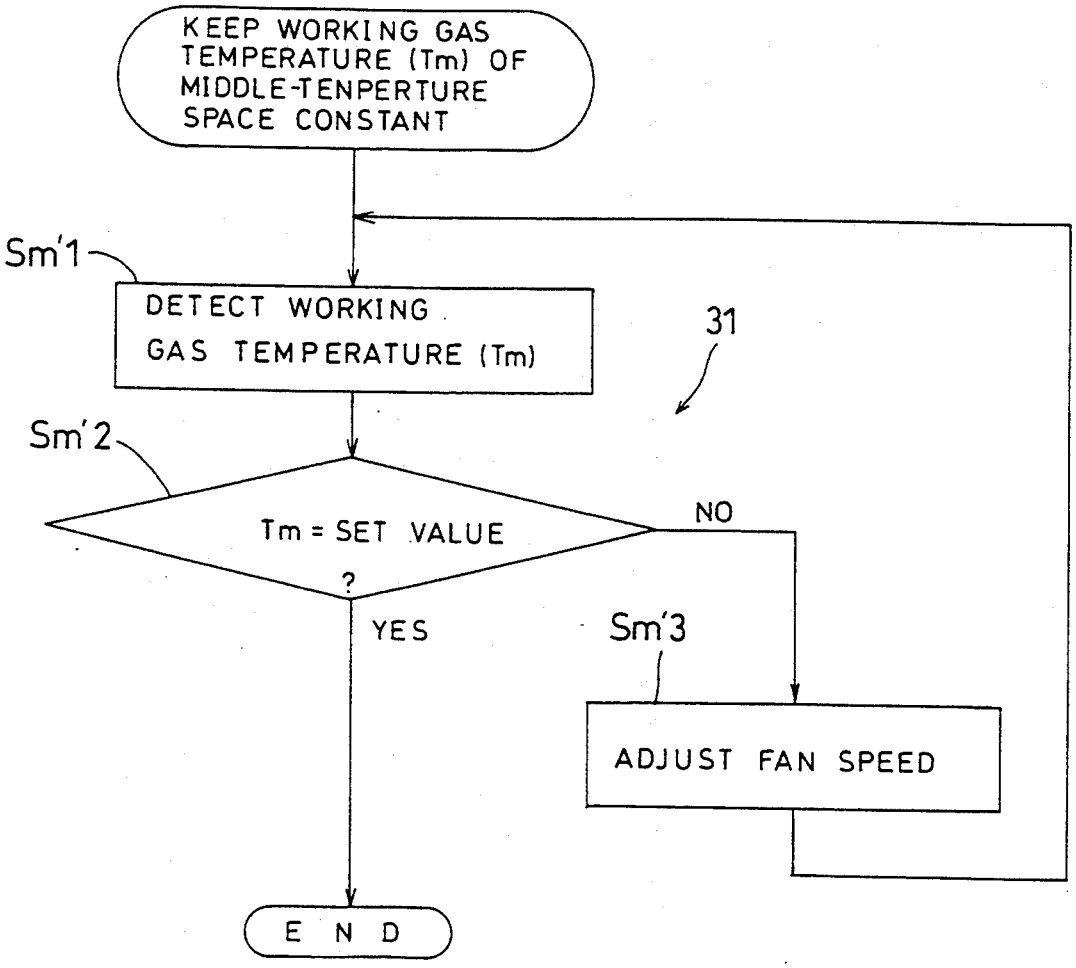
FIG. 15 is a flow chart showing a processing operation for keeping working gas temperature of the middle-temperature space constant at the capability control in the second embodiment.

The processing operation for keeping the working gas temperatures (Tc), (Tm) of the cold space (9L) and the middle-temperature space (10L) constant at the capability control by the controller (33) is conducted along flow charts of FIGS. 14 and 15. In detail, in this processing operation, steps Sc'1 and Sc'2 in FIG. 14 are respectively identical with the steps Sc1 and Sc2 in FIG. 5, steps Sm'1 and Sm'2 in FIG. 15 are respectively identical with the steps Sm1 and Sm2 in FIG. 6, and the only other steps Sc'3 and Sm'3 are different from the respective steps Sc3 and Sm3. Each step Sc'3, Sm'3, the fan speed is adjusted when the respective working gas temperatures (Tc), (Tm) are different from respective set temperatures.

The steps Sc'2, Sc'3 in the above processing are embodied in the heat input adjusting means (28) for controlling the motor for the fan (27*b*) of the heat input circuit (22) so as to increase the heat input in accordance with the drop of the working gas temperature (Tc) of the cold space (9L) upon receipt of an output signal of the cold space temperature sensor (26).

Also, the steps Sm'2, Sm'3 are embodied in the heat output control means (31) for controlling the motor for the fan (30*b*) of the radiation circuit (24) so as to increase the heat output in accordance with the rise of the working gas temperature (Tm) of the middle-temperature space (10L) upon receipt of an output signal of the middle-temperature space temperature sensor (29).

Figure 17:
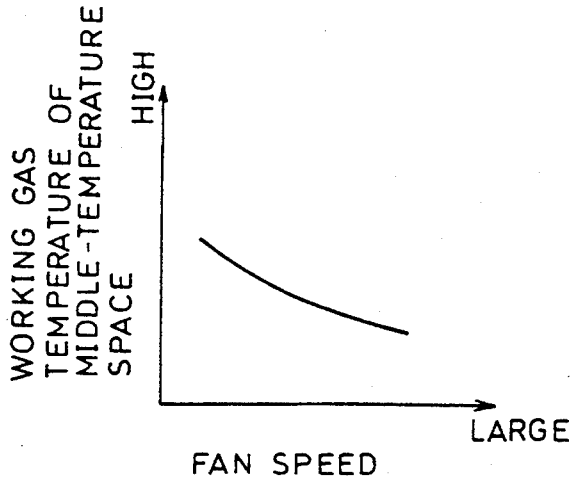
FIG. 17 is a graph showing a relation between fan speed and temperature of the middle-temperature space in the second embodiment.
Figure 16:
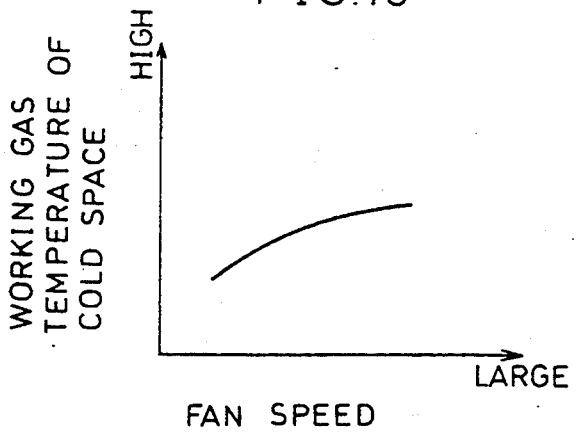
FIG. 16 is a graph showing a relation between fan speed and temperature of the cold space in the second embodiment.

Accordingly, in this embodiment, the increase in the speeds of the fans (27*b*), (30*b*) prevents the rise of the working gas temperature (Tc) of the cold space (9L) and the drop of the working gas temperature (Tm) of the middle-temperature space (10L) as shown in FIGS. 16 and 17. Thus, the same effect as in the first embodiment can be displayed in this embodiment.

Figure 18:
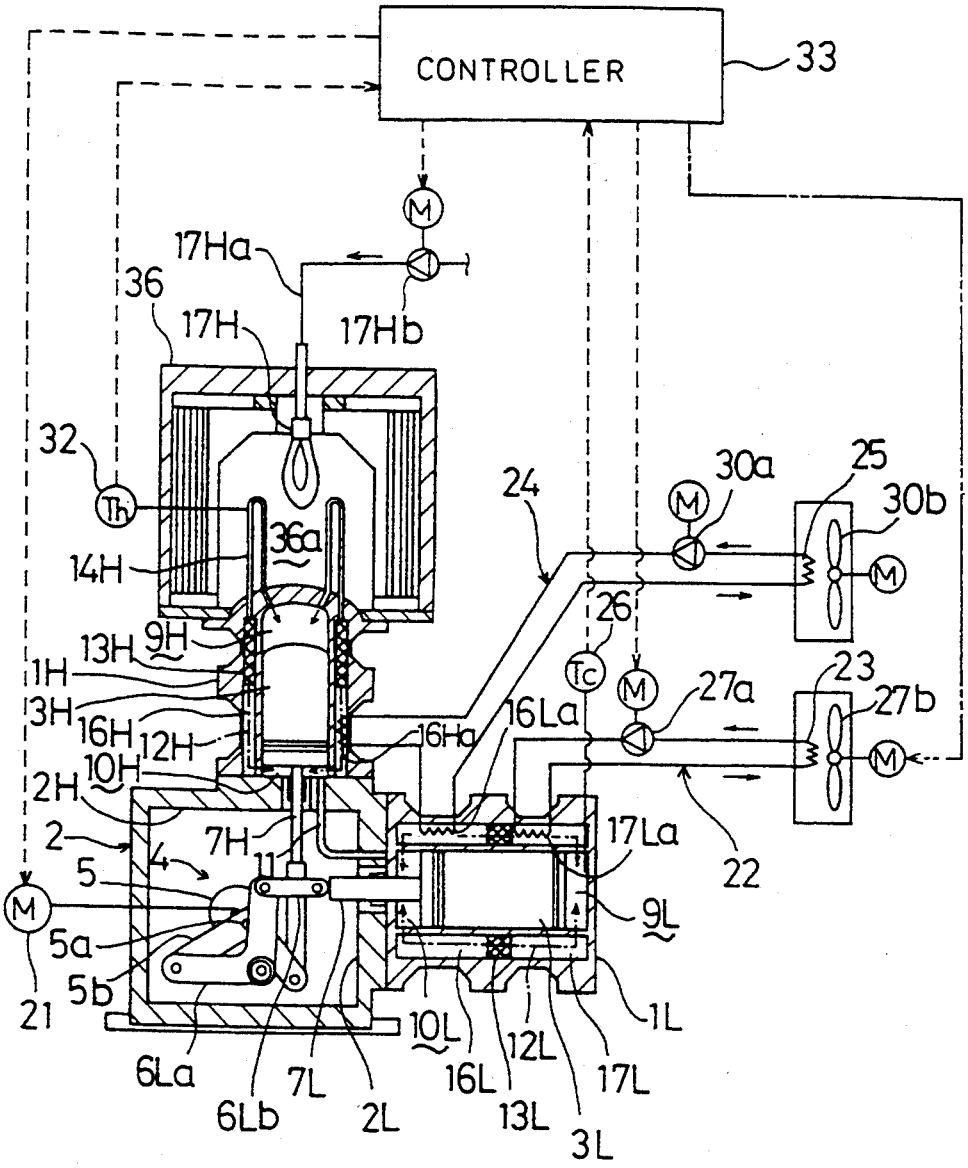
FIG. 18 illustrates a whole construction of a vuilleumier heat pump device according to a third embodiment of the present invention.

FIG. 18 shows a third embodiment of the present invention. Both flow rate of circulation water (Qw) of the heat input circuit (22) and the radiation circuit (24) are adjusted in the first embodiment, while only the flow rate of circulation water (Qw) of the heat input circuit (22) is adjusted in the third embodiment.

In detail, the middle-temperature space temperature sensor (29) as the middle-temperature space temperature detection means for detecting the working gas temperature (Tm) of the middle-temperature space (10L) in the cold side cylinder (1L) in the first embodiment (refer to FIG. 2) is omitted from this embodiment. Further, the controller is not connected to the motor for the pump (30*a*) of the radiation circuit (24) so that the flow rate of circulation water (Qw) of the radiation circuit (24) is constant.

Figure 19:
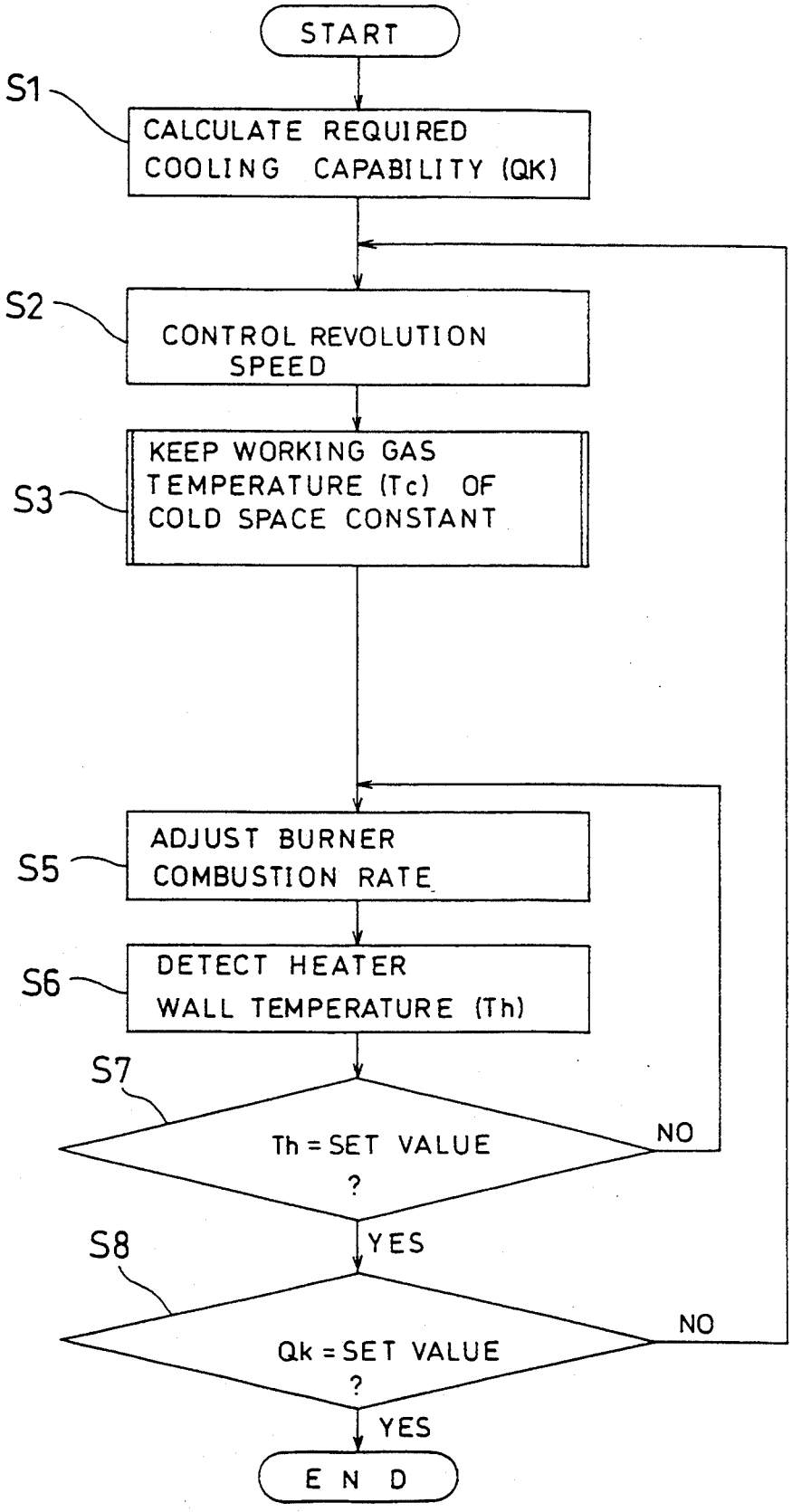
FIG. 19 is a flow chart showing processing operation at capability control in the third embodiment.

In addition, the processing operation of the capability control which is conducted by the controller (33) is as shown in FIG. 19, in which only the step S4 for keeping the working gas temperature (Tm) of the middle-temperature space (10L) constant is omitted compared with the first embodiment. Accordingly, the heat output control means (31) is omitted. The other steps are identical therewith in the first embodiment (refer to FIG. 4).

Figure 20:
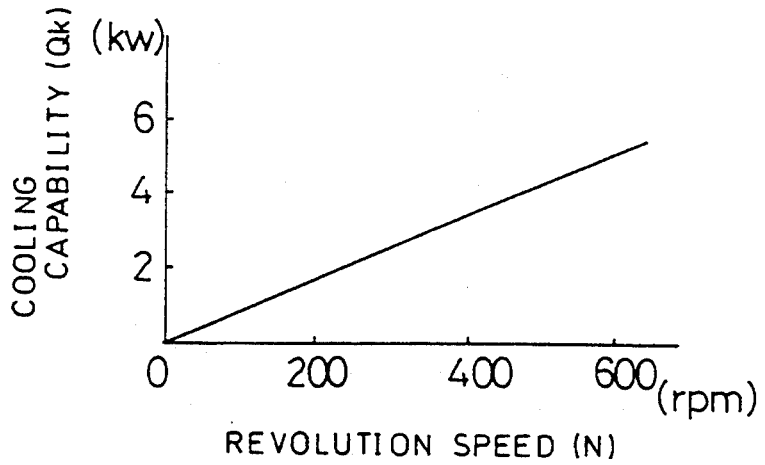
FIG. 20 is a graph showing a relation between cooling capability and revolution speed in the third embodiment.

Consequently, in order to enhance the cooling capability (Qk) of the cooler (17L) in this embodiment, upon control of the revolution speed (N), the cooling capability (Qk) is increased in accordance with increase in the revolution speed (N) as shown in FIG. 20.

Figure 21:
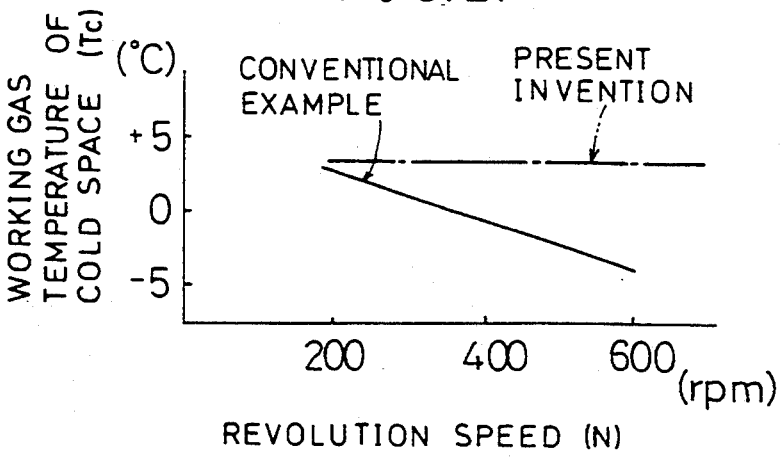
FIG. 21 is a graph showing a relation between temperature of the cold space and revolution speed in the third embodiment.
Figure 22:
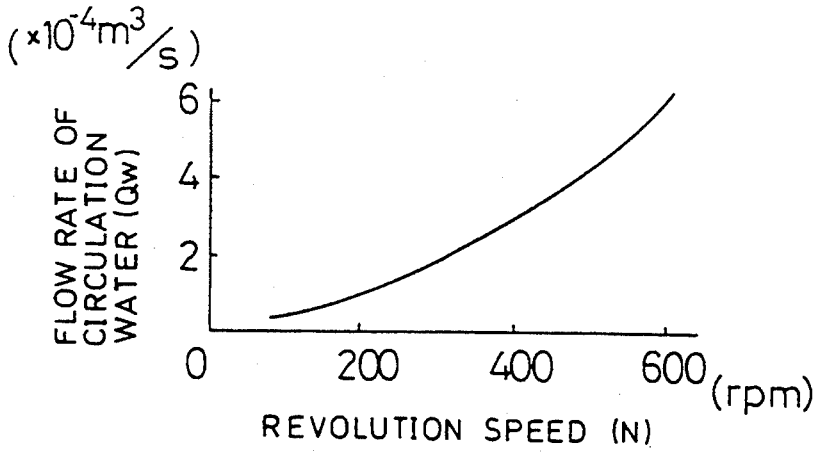
FIG. 22 is a graph showing a relation between flow rate of circulation water in the heat input circuit and revolution speed in the third embodiment.
Figure 23:
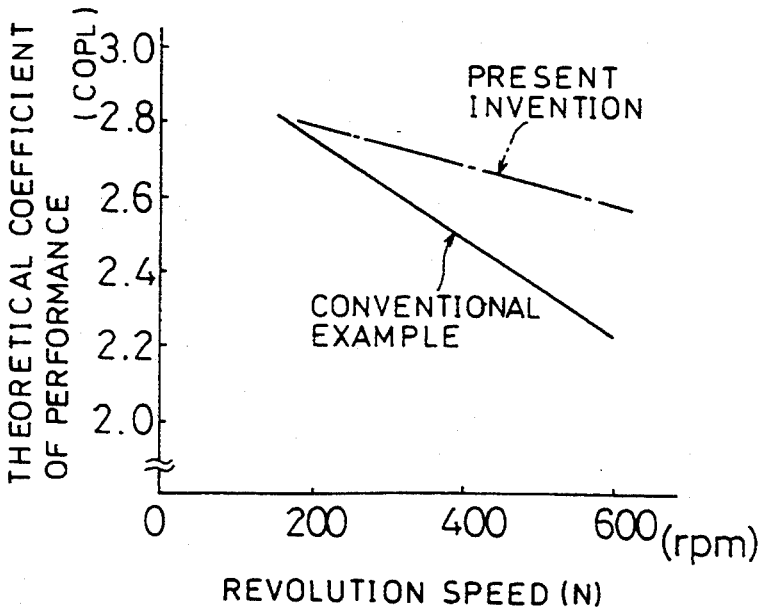
FIG. 23 is a graph showing a relation between coefficient of performance and revolution speed in the third embodiment.

At this time, in the conventional example, the working gas temperature (Tc) of the cold space (9L) drops as indicated by a solid line in FIG. 21, which lowers the coefficient of performance ($COP_L$) as indicated by a solid line in FIG. 23. While, in this embodiment, the working gas temperature (Tc) of the cold space (9L) is detected by the cold space temperature sensor (26), and the motor for the pump (27a) of the heat input circuit (22) is controlled by the controller (33) upon receipt of an output signal of the sensor (26) to increase the flow rate of circulation water (Qw) of the heat input circuit (22) as shown in FIG. 22. Thereby, the heat input of the water in the heat input circuit (22) from the indoor air is increased at the indoor heat exchanger (23) to raise the temperature of the water in the heat input circuit (22) by the increase of the heat input. This temperature rise of the water increases the heat input of the working gas from the water at the cooler (17L) to raise the working gas temperature, and makes the working gas flow into the cold space (9L) in the cold side cylinder (1L) through the cold communication passage (12L). Accordingly, the increase in the flow rate of circulation water (Qw) prevents the drop of the working gas temperature (Tc), and the working gas temperature (Tc) is almost kept constant as indicated by a dot-dash line in FIG. 21, regardless of the increase in the revolution speed (N).

The relation between the flow rate of circulation water (Qw) and the working gas temperature (Tc) is referred to in detail. Suppose that the working gas temperature (Tc) of the cold space (9L) is −3.6° C. and the working gas temperature (Tm) of the middle-temperature space (10L) is 72.5° C. when each flow rate of circulation water (Qw) is 12.61/min. under the control of, for example, 650° C. working gas temperature (Th) of the hot space (9H) and 600 rpm revolution speed (N), the coefficient of performance ($COP_L$) is 2.22.

When the flow rate of circulation water (Qw) of the heat input circuit (22) is increased to 36.61/min., the working gas temperature (Tc) of the cold space (9L) rises to 0.3° C. (wherein the working gas temperature (Tm) of the middle-temperature space (10L) remains 72.5° C.). The coefficient of performance ($COP_L$) is increased to 2.63 in this case.

In this way, since the working gas temperature (Tc) is kept constant, the lowering of the coefficient of performance ($COP_L$) is gradually lessened, as indicated by a dot-dash line in FIG. 23 to be almost constant.

Figure 24:
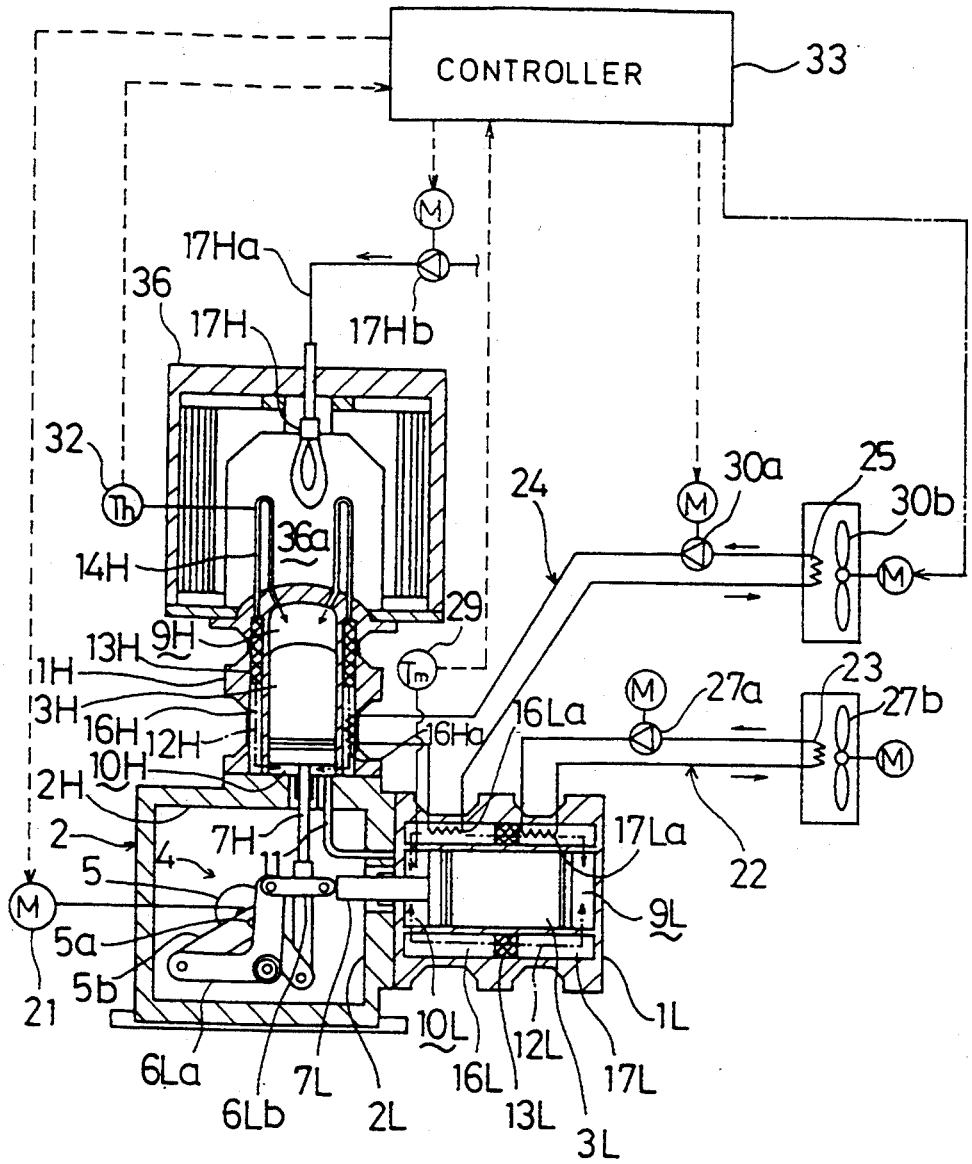
FIG. 24 illustrates a whole construction of a vuilleumier heat pump device according to a fourth embodiment of the present invention.

FIG. 24 shows a fourth embodiment of the present invention, wherein the flow rate of circulation water (Qw) of the radiation circuit (24) is adjusted, in comparison with the third embodiment in which the flow rate of circulation water (Qw) of the heat input circuit (22) is adjusted.

In detail, in this embodiment, different from the third embodiment, the cold space temperature sensor (26) as the cold space temperature detection means for detecting the working gas temperature (Tc) of the cold space (9L) in the cold side cylinder (1L) in the first embodiment is omitted. Also, the controller (33) is not connected to the motor for the pump (27a) of the heat input circuit (22) so that the flow rate of circulation water (Qw) of the heat input circuit (22) is kept constant.

Figure 25:
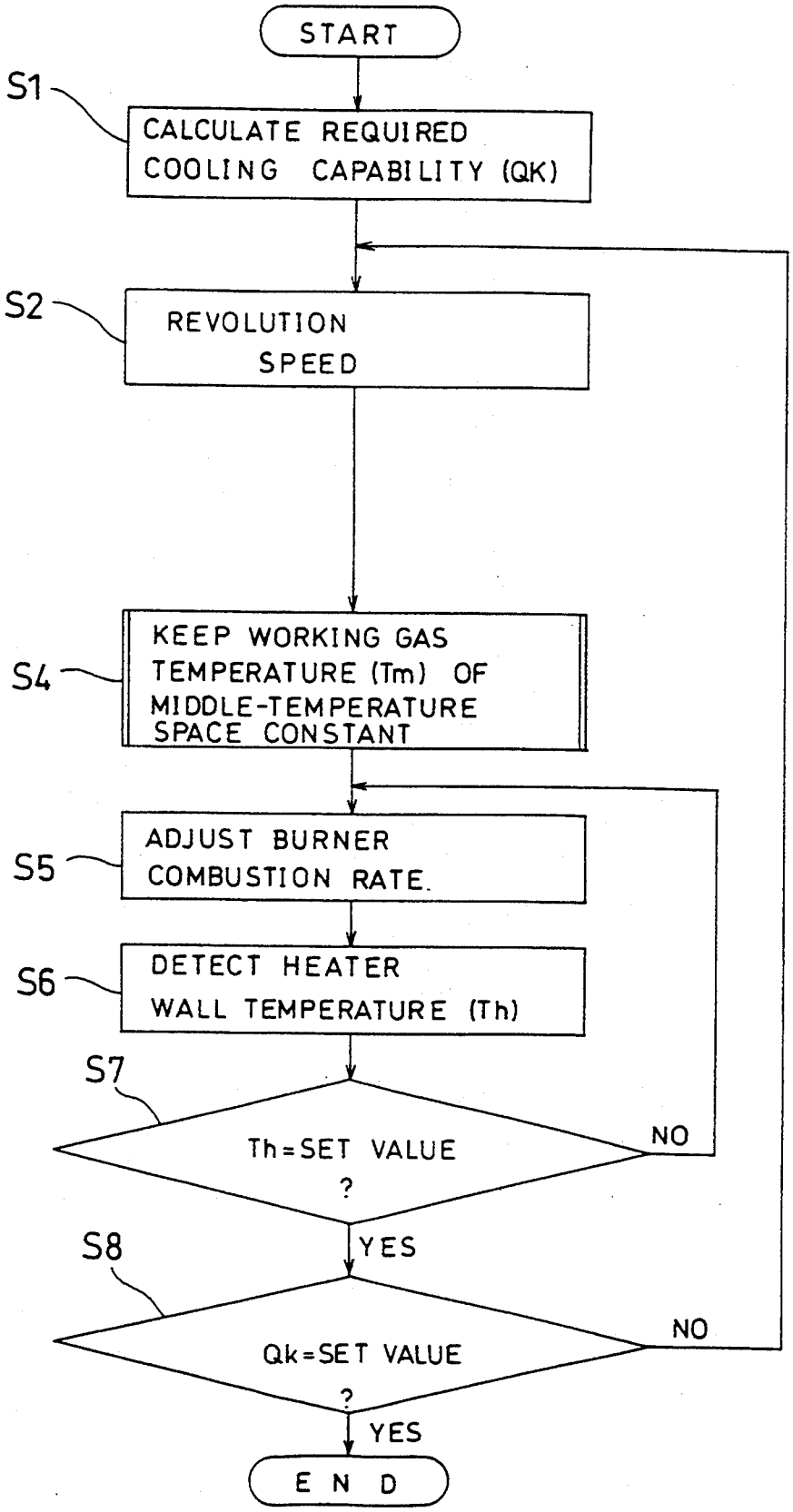
FIG. 25 is a flow chart showing a processing operation at the capability control in the fourth embodiment.

The processing operation of the capability control by the controller (33) is conducted as shown in FIG. 25, wherein, compared with the first embodiment, only the step S3 for keeping the working gas temperature (Tc) of the cold space (9L) constant is omitted. Accordingly, the heat input control means (28) is omitted. The other steps are identical therewith in the first embodiment.

Figure 26:
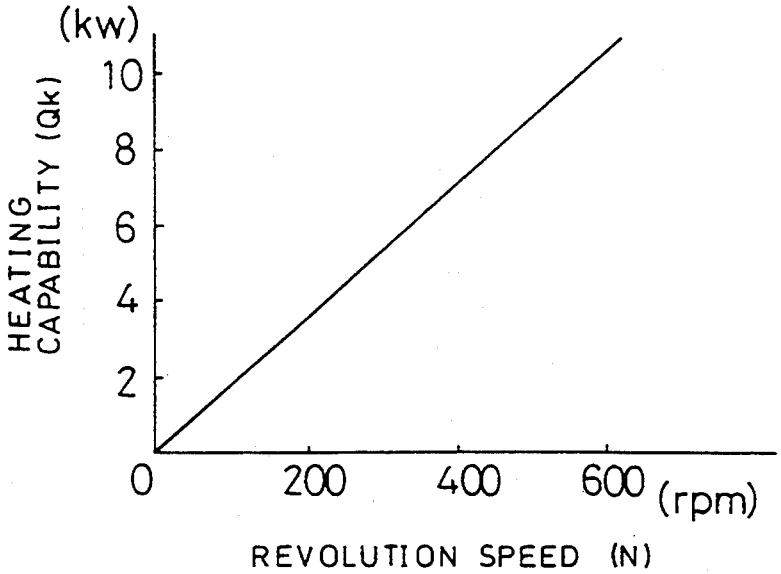
FIG. 26 is a graph showing a relation between heating capability and revolution speed in the fourth embodiment.

Consequently, in this embodiment, the revolution speed (N) is controlled so as to increase the heating capability (Qk) in accordance with the increase in the revolution speed (N) as shown in FIG. 26.

Figure 27:
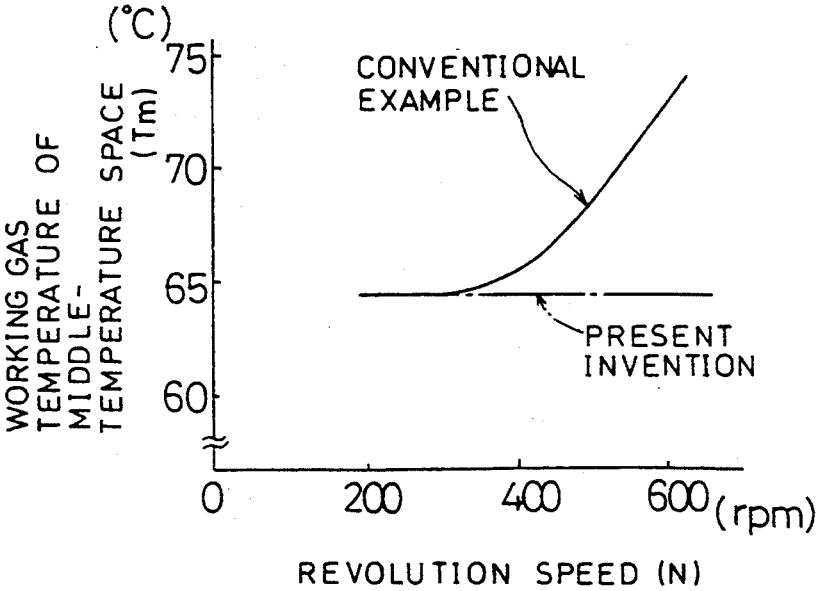
FIG. 27 is a graph showing a relation between temperature of the middle-temperature space and revolution speed in the fourth embodiment.
Figure 28:
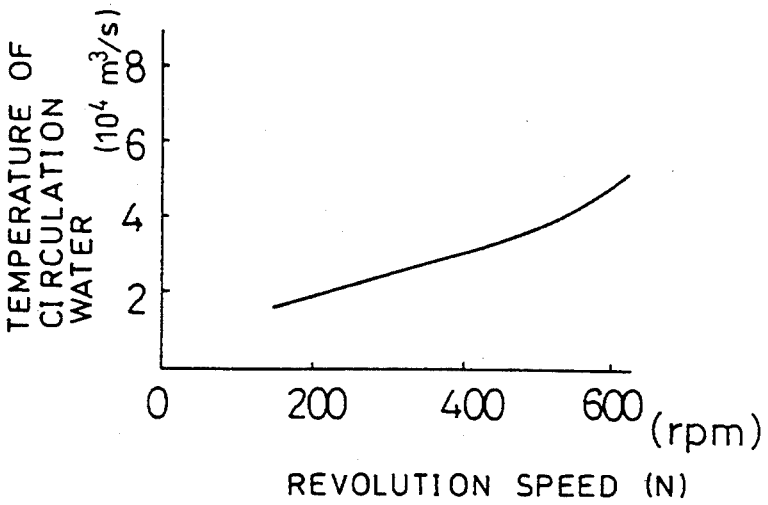
FIG. 28 is a graph showing a relation between flow rate of circulation water in the radiation circuit and revolution speed in the fourth embodiment.
Figure 29:
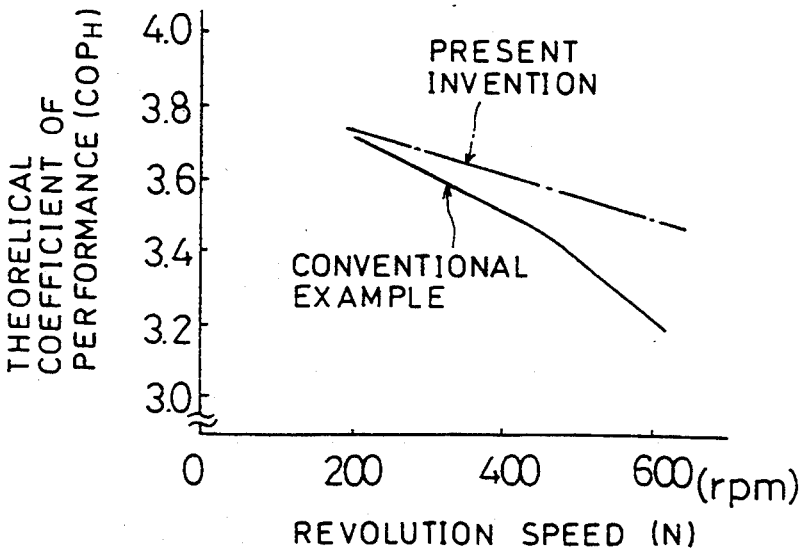
FIG. 29 is a graph showing a relation between coefficient of performance and revolution speed in the fourth embodiment.

At this time, in the conventional example, when the working gas temperature (Tm) of the middle-temperature space (10L) rises as indicated by a solid line in FIG. 27, the heating efficiency ($COP_H$) is lowered as indicated by a solid line in FIG. 29. However, in the present invention, the working gas temperature (Tm) of the middle-temperature space (10L) is detected by the middle-temperature space temperature sensor (29), and the motor for the pump (30a) of the radiation circuit (24) is controlled by the controller (33) upon receipt of an output signal of the sensor (29) to increase the flow rate of circulation water (Qw) of the radiation circuit (24) as shown in FIG. 28. Thereby, the heat output of the water in the radiation circuit (24) to the outdoor air is increased at the outdoor heat exchanger (25), so that the temperature of the water in the radiation circuit (24) drops by the increase of the heat output. This temperature drop of the water increases the heat output of the working gas to the water at the middle-temperature heat exchangers (16H), (16L) to lower the working gas temperature, and makes the working gas flow into the respective middle-temperature spaces (10H), (10L) in the hot side cylinder (1H) and the cold side cylinder (1L) through the hot communication passage (12H) and the cold communication passage (12L). Accordingly, the increase in the flow rate of circulation water (Qw) prevents the rise in the working gas temperature (Tm), and the working gas temperature (Tm) is kept almost constant as indicated by a dot-dash line in FIG. 27, regardless of the increase in the revolution speed (N).

The relation between the flow rate of circulation water (Qw) and the working gas temperature (Tm) is referred to in detail. Suppose that the working gas temperature (Tc) of the cold space (9L) is −3.6° C. and the working gas temperature (Tm) of the middle-temperature space (10L) is 72.5° C. when each flow rate of circulation water (Qw) is 12.61/min. under the control of 650° C. working gas temperature (Th) of the hot space (9H) and 600 rpm revolution speed (N), the coefficient of performance ($COP_H$) is 3.23.

When the flow rate of circulation water (Qw) of the radiation circuit (24) is increased to 30.01/min., the working gas temperature (Tc) of the cold space (9L) and the working gas temperature (Tm) of the middle-temperature space (10L) are respectively lowered to −4.3° C. and 65.4° C. and the coefficient of performance ($COP_H$) is increased to 3.43.

Consequently, the constant working gas temperature (Tm) makes the coefficient of performance almost constant as indicated by a dot-dash line in FIG. 29.

In third and fourth embodiments, either of the flow rates of circulation water (Qw) of the heat input circuit (22) or the radiation circuit (24) is adjusted. However, as well as in the second embodiment, only one of the speeds of the fans (27*b*), (30*b*) may be increased to prevent the rise in the working gas temperature (Tc) of the cold space (9L) or the drop of the working gas temperature (Tm) of the middle-temperature space (10L). The same effect as in third and fourth embodiments are obtained in this case (control signal systems to the fans (27*b*), (30*b*) are respectively indicated by imaginary lines in FIGS. 18 and 24).

INDUSTRIAL APPLICABILITY

The present invention has high industrial applicability in promoting to put into practice a vuilleumier heat pump device utilized as cooling/heating device without flon refrigerant, because the present invention avoids the lowering of the coefficient of performance upon increase in the cooling capability or the heating capability.

We claim:

1. A vuilleumier heat pump device having:

a hot side displacer (3H) defining a hot side cylinder (1H) into a hot space (9H) and a hot side middle-temperature space (10H) which are filled with an working gas;

a cold side displacer (3L) defining a cold side cylinder (1L) into a cold space (9L) and a cold side middle-temperature space (10L) which are filled with an working gas;

connection means (4) for connecting the hot side displacer (3H) and the cold side displacer (3L) so as to be in reciprocal motion at a set phase difference;

revolution speed adjusting means (21) driven and connected to each displacer (3H), (3L) through the connection means (4);

a hot communication passage (12H) interconnecting the hot space (9H) and the middle-temperature space (10H) in the hot side cylinder (1H), and provided with a heater part (14H) and a hot side middle-temperature heat exchanger (16H) radiating heat to a radiation medium by heat exchange with the working gas;

heating means (17H) for heating the heater part (14H);

a cold communication passage (12L) interconnecting the cold space (9L) and the middle-temperature space (10L) in the cold side cylinder (1L), and provided with a cooler part (17L) absorbing heat from an endothermic medium by heat exchange with the working gas and a cold side middle-temperature heat exchanger (16L) radiating heat to a radiation medium by heat exchange with the working gas;

an endothermic heat exchanger (23) connected to the cooler part (17L) via a heat input circuit (22) circulating and flowing the endothermic medium, and absorbing heat from an external medium by heat exchange with the endothermic medium; and a radiation heat exchanger (25) connected to the middle-temperature heat exchangers (16H). (16L) via a radiation circuit (24) circulating and flowing the radiation medium, and radiating heat to the external medium by heat exchange with the radiation medium, the vullleumier heat pump device comprising:

cold space temperature detection means (26) for detecting an working gas temperature (Tc) of the cold space (9L);

heat input adjusting means (27) for increasing or decreasing heat input of the endothermic heat exchanger (23);

heat input control means (28) for controlling the heat input adjusting means (27) so as to increase the heat input in accordance with drop of the working gas temperature (Tc) upon receipt of an output signal of the cold space temperature detection means (26);

middle-temperature space temperature detection means (29) for detecting an working gas temperature (Tm) of the middle-temperature spaces (10H), (10L);

heat output adjusting means (30) for increasing or decreasing the heat output of the radiation heat exchanger (25); and heat output control means (31) for controlling the heat output adjusting means (30) so as to increase the heat output in accordance with rise in the working gas temperature (Tm) upon receipt of an output signal of the middle-temperature space temperature detection means (29).

2. A vuilleumier heat pump device having:

a hot side displacer (3H) defining a hot side cylinder (1H) into a hot space (9H) and a hot side middle-temperature space (10H) which are filled with an working gas;

a cold side displacer (3L) defining a cold side cylinder (1L) into a cold space (9L) and a cold side middle-temperature space (10L) which are filled with an working gas;

connection means (4) for connecting the hot side displacer (3H) and the cold side displacer (3L) so as to be in reciprocal motion at a set phase difference;

revolution speed adjusting means (21) driven and connected to each displacer (3H), (3L) through the connection means (4);

a hot communication passage (12H) interconnecting the hot space (9H) and the middle-temperature space (10H) in the hot side cylinder (1H), and provided with a heater part (14H) and a hot side middle-temperature heat exchanger (16H) radiating heat to a radiation medium by heat exchange with the working gas;

heating means (17H) for heating the heater part (14H);

a cold communication passage (12L) interconnecting the cold space (9L) and the middle-temperature space (10L) in the cold side cylinder (1L), and provided with a cooler part (17L) absorbing heat from an endothermic medium by heat exchange with the working gas and a cold side middle-temperature heat exchanger (16L) radiating heat to a radiation medium by heat exchange with the working gas;

an endothermic heat exchanger (23) connected to the cooler part (17L) via a heat input circuit (22) circulating and flowing the endothermic medium, and absorbing heat from an external medium by heat exchange with the endothermic medium; and a radiation heat exchanger (25) connected to the middle-temperature heat exchangers (16H), (16L) via a radiation circuit (24) circulating and flowing the radiation medium, and radiating heat to the external medium by heat exchange with the radiation medium, the vuilleumler heat pump device comprising:

cold space temperature detection means (26) for detecting an working gas temperature (Tc) of the cold space (9L);

heat input adjusting means (27) for increasing or decreasing the heat input of the endothermic heat exchanger (23); and heat input control means (28) for controlling the heat input adjusting means (27) so as to increase the heat input in accordance with drop of the working gas temperature (Tc) upon receipt of an output signal of the cold space temperature detection means (26).

3. The vuilleumler heat pump device as defined in claim 1 or 2, wherein the heat input adjusting means (27) is a pump (27*a*) for circulating and flowing the endothermic medium along the heat input circuit (22), and the heat input of the endothermic heat exchanger (23) is increased by increasing a flow rate of the endothermic medium by the pump (27*a*).

4. The vuilleumier heat pump device as defined in claim 1 or 2, wherein the heat input adjusting means (27) is a fan (27*b*) for flowing an external medium at the endothermic heat exchanger (23), and the heat input of the endothermic heat exchanger is increased by increasing a flowing rate of the external medium by the fan (27*b*).

5. A vuilleumier heat pump device having:

a hot side displacer (3H) defining a hot side cylinder (1H) into a hot space (9H) and a hot side middle-temperature space (10It) which are filled with an working gas;

a cold side displacer (3L) defining a cold side cylinder (1L) into a cold space (9L) and a cold side middle-temperature space (10L) which are filled with an working gas;

connection means (4) for connecting the hot side displacer (3H) and the cold side displacer (3L) so as to be in reciprocal motion at a set phase difference;

revolution speed adjusting means (21) driven and connected to each displacer (3H), (3L) through the connection means (4);

a hot communication passage (12H) interconnecting the hot space (9H) and the middle-temperature space (1OH) in the hot side cylinder (1H), and provided with a heater part (14H) and a hot side middle-temperature heat exchanger (16H) radiating heat to a radiation medium by heat exchange with the working gas;

heating means (17H) for heating the heater part (14H);

a cold communication passage (12L) interconnecting the cold space (9L) and the middle-temperature space (10L) in the cold side cylinder (1L), and provided with a cooler part (17L) absorbing heat from an endothermic medium by heat exchange with the working gas and a cold side middle-temperature heat exchanger (16L) radiating heat to a radiation medium by heat exchange with the working gas;

an endothermic heat exchanger (23) connected to the cooler part (17L) via a heat input circuit (22) circulating and flowing the endothermic medium, and absorbing heat from an external medium by heat exchange with the endothermic medium; and a radiation heat exchanger (25) connected to the middle-temperature heat exchangers (16H), (16L) via a radiation circuit (24) circulating and flowing the radiation medium, and radiating heat to the external medium by heat exchange with the radiation medium, the vuilleumier heat pump device comprising:

middle-temperature space temperature detection means (29) for detecting an working gas temperature (Tm) of the middle-temperature spaces (10H), (10L);

heat output adjusting means (30) for increasing or decreasing the heat output of the radiation heat exchanger (25); and heat output control means (31) for controlling the heat output adjusting means (30) so as to increase the heat output in accordance with rise in the working gas temperature (Tm) upon receipt of an output signal of the middle-temperature space temperature detection means (29).

6. The vuilleumier heat pump device as defined in claim 1 or 5, wherein the heat output adjusting means (30) is a pump (30*a*) for circulating and flowing a radiation medium along the radiation circuit (24), and the heat output of the radiation heat exchanger (25) is increased by increasing a flowing rate of the radiation medium by the pump (30*a*).

7. The vuilleumier heat pump device as defined in claim 1 or 5, wherein the heat output adjusting means (30) is a fan (30*b*) for flowing an external medium at the radiation heat exchanger (25), and the heat output of the radiation heat exchanger (25) is increased by increasing a flowing rate of the external medium by the fan (30*b*).

* * * * *